US007712411B2

(12) United States Patent
Monden et al.

(10) Patent No.: US 7,712,411 B2
(45) Date of Patent: May 11, 2010

(54) STENCIL PRINTING APPARATUS FOR DUPLEX OR SIMPLEX PRINTING

(75) Inventors: Tomohiro Monden, Miyagi (JP); Toshiharu Hasegawa, Miyagi (JP); Mituru Takahashi, Miyagi (JP)

(73) Assignee: Tohoku Ricoh Co., Ltd, Shibata-gun (JP)

( * ) Notice: Subject to any disclaimer, the term of this patent is extended or adjusted under 35 U.S.C. 154(b) by 520 days.

(21) Appl. No.: 11/680,265

(22) Filed: Feb. 28, 2007

(65) Prior Publication Data

US 2007/0251402 A1 Nov. 1, 2007

(30) Foreign Application Priority Data

May 1, 2006 (JP) ..... 2006-127878

(51) Int. Cl.
*B41L 13/16* (2006.01)

(52) U.S. Cl. ..... 101/116; 101/484

(58) Field of Classification Search ..... 101/116, 101/484, 128.4; *B41L 13/16*
See application file for complete search history.

(56) References Cited

U.S. PATENT DOCUMENTS 6,718,872 B2 4/2004 Kanno
7,325,492 B2 * 2/2008 Kobayashi ..... 101/116

FOREIGN PATENT DOCUMENTS

JP 2005-246730 9/2005

* cited by examiner

*Primary Examiner*—Leslie J Evanisko
(74) *Attorney, Agent, or Firm*—Oblon, Spivak, McClelland, Maier & Neustadt, L.L.P.

(57) ABSTRACT

A stencil printing apparatus which suppresses master consumption by switching between simplex printing using a simplex master and single-step duplex printing using a duplex master automatically in accordance with master information and sheet information comprises a printing drum and pressing means, and can be made to switch between duplex printing, in which a rear surface printing step is performed after a front surface printing step, and simplex printing by wrapping a duplex master formed with a first engraved image and a second engraved image around the printing drum during duplex printing, and wrapping a simplex master formed with a third engraved image for simplex printing around the printing drum during simplex printing. Master identification information, indicating whether the master was engraved with duplex printing images or a simplex printing image during engraving, is stored in a storage unit in association with plate cylinder identification information, and either a duplex printing mode or a simplex printing mode is selected on the basis of plate cylinder identification information obtained anew when an operation command or a plate cylinder attachment/detachment command is input into the apparatus, and the master identification information stored in the storage unit.

4 Claims, 20 Drawing Sheets

50
STORAGE UNIT
30
OPERATING PANEL
40
CONTROL MEANS
6
SHEET DISCHARGE UNIT
7
IMAGE READING UNIT
8
SHEET RE-FEEDING MEANS
9
SWITCHING MEMBER
56
DRUM ATTACHMENT DETECTION SENSOR
42
SHEET TYPE DETECTION SENSOR
55
DRUM TYPE DETECTION SENSOR
2
PRINTING UNIT
3
ENGRAVING UNIT
4
SHEET FEEDING UNIT
5
PLATE DISCHARGE UNIT

STENCIL PRINTING APPARATUS FOR DUPLEX OR SIMPLEX PRINTING

BACKGROUND OF THE INVENTION

1. Field of the Invention

The present invention relates to a stencil printing apparatus, and more particularly to a stencil printing apparatus that is capable of switching between simplex printing using a simplex master and single-step duplex printing using a duplex master.

2. Description of the Background Art

Digital thermal stencil printing is known as a simple conventional printing method. In a stencil printing apparatus used for this stencil printing, a thermal head on which fine heat-generating elements are arranged in series is brought into contact with a master, and the master is conveyed while electrifying the heat-generating elements in a pulsating fashion such that the master is thermally melt-perforated in accordance with image information. The master is then wrapped around the outer peripheral surface of a perforated cylindrical plate cylinder, whereupon the outer peripheral surface of the plate cylinder is pressed via a sheet of paper using pressing means such as a press roller. As a result, ink is transmitted through the perforated portions of the master and transferred onto the sheet, whereby a printed image is obtained.

In stencil printing, duplex printing, in which printing is performed on both sides of a sheet, is often performed recently with the aims of reducing paper consumption, reducing the amount of space required to store documents, and so on. When duplex printing is performed using a conventional method, a sheet printed on both sides is obtained by conveying a sheet stacked on a sheet feeding unit to a printing unit, where printing is performed on one side of the sheet, turning the sheet over, and then returning the sheet to the printing unit, where printing is performed on the other side. However, this method is problematic in that it is troublesome to reset the sheet in the sheet feeding unit after it has been discharged and align the sheet after printing has been performed on one side. Furthermore, since the sheet passes through the printing unit twice, another problem arises in that duplex printing requires twice the time of simplex printing even in terms of the net printing time, which is excessive.

To solve these problems, a duplex printing apparatus that is capable of obtaining a sheet printed on both sides in a single step has been proposed in Japanese Unexamined Patent Application Publication 2005-246730, for example. In this apparatus, a duplex master on which a first engraved image and a second engraved image are arranged in the rotation direction of a plate cylinder is used. A first sheet is then fed from a sheet feeding unit and one of the engraved images is printed onto the front surface thereof. The sheet is then guided to an auxiliary tray, whereupon a second sheet is fed from the sheet feeding unit and one of the engraved images is printed onto the front surface thereof. The second sheet is then guided to the auxiliary tray, and at the same time, the first sheet is re-fed from the auxiliary tray and the other engraved image is printed onto the rear surface thereof. This sheet is then discharged onto a discharge tray. By performing this operation continuously, a sheet printed on both sides is obtained in a single step.

However, if a plurality of plate cylinders are used alternately when employing the technique disclosed in this publication, and the master wrapped around the plate cylinder has been engraved with duplex printing images, only engraving and simplex printing can be performed, and to print the same image on both sides, engraving must be performed again, leading to an increase in master consumption.

SUMMARY OF THE INVENTION

It is an object of the present invention to provide a stencil printing apparatus which reduces master consumption by switching between simplex printing using a simplex master and single-step duplex printing using a duplex master automatically in accordance with master information and sheet information.

In an aspect of the present invention, a stencil printing apparatus has a plate cylinder that can be attached to and detached from an apparatus main body freely and a pressing device provided so as to be free to contact and separate from the plate cylinder. With duplex printing, a rear surface printing step is performed after a front surface printing step, and simplex printing can be performed alternately by wrapping a duplex master formed with a first engraved image and a second engraved image in a length direction thereof around the plate cylinder during duplex printing, and wrapping a simplex master formed with a third engraved image for simplex printing around the plate cylinder during simplex printing. The stencil printing apparatus comprises a storage unit for storing master identification information, indicating whether the master is engraved with duplex printing images or a simplex printing image during engraving, in association with plate cylinder identification information; and a control device for selecting a duplex printing mode or a simplex printing mode on the basis of at least plate cylinder identification information obtained anew when an operation command or a plate cylinder attachment/detachment command is input into the apparatus, and the master identification information stored in the storage unit in association with the plate cylinder identification information.

In another aspect of the present invention, a stencil printing apparatus has a plate cylinder that can be attached to and detached from an apparatus main body freely and a pressing device provided so as to be free to contact and separate from the plate cylinder. With duplex printing, a rear surface printing step is performed after a front surface printing step, and simplex printing can be performed alternately by wrapping a duplex master formed with a first engraved image and a second engraved image in a length direction thereof around the plate cylinder during duplex printing, and wrapping a simplex master formed with a third engraved image for simplex printing around the plate cylinder during simplex printing. The stencil printing apparatus comprises a storage unit for storing master identification information, indicating whether the master is engraved with duplex printing images or a simplex printing image during engraving, in association with plate cylinder identification information; and a control device for displaying the master identification information on display means on the basis of at least plate cylinder identification information obtained anew when an operation command or a plate cylinder attachment/detachment command is input into the apparatus, and the master identification information stored in the storage unit in association with the plate cylinder identification information.

In another aspect of the present invention, a stencil printing apparatus has a plate cylinder that can be attached to and detached from an apparatus main body freely and a pressing device provided so as to be free to contact and separate from the plate cylinder. With duplex printing, a rear surface printing step is performed after a front surface printing step, and simplex printing can be performed alternately by wrapping a duplex master formed with a first engraved image and a second engraved image in a length direction thereof around the plate cylinder during duplex printing, and wrapping a simplex master formed with a third engraved image for simplex printing around the plate cylinder during simplex printing. The stencil printing apparatus comprises a storage unit for storing master identification information, indicating whether the master is engraved with duplex printing images or a simplex printing image during engraving, in association with plate cylinder identification information; and a control device for executing a warning operation when at least plate cylinder identification information obtained anew when an operation command or a plate cylinder attachment/detachment command is input into the apparatus differs from the master identification information stored in the storage unit in association with the plate cylinder identification information.

In another aspect of the present invention, a stencil printing apparatus has a plate cylinder that can be attached to and detached from an apparatus main body freely and a pressing device provided so as to be free to contact and separate from the plate cylinder. During duplex printing, a rear surface printing step is performed after a front surface printing step, and simplex printing can be performed alternately by wrapping a duplex master formed with a first engraved image and a second engraved image in a length direction thereof around the plate cylinder during duplex printing, and wrapping a simplex master formed with a third engraved image for simplex printing around the plate cylinder during simplex printing. The stencil printing apparatus comprises a storage unit for storing master identification information, indicating whether the master is engraved with duplex printing images or a simplex printing image during engraving, and sheet size information corresponding to the master identification information, in association with plate cylinder identification information; a sheet size detecting device for detecting a sheet; and a control device for executing a warning operation when at least plate cylinder identification information obtained anew when an operation command or a plate cylinder attachment/detachment command is input into the apparatus and sheet size detection information from the sheet size detecting device differ from the master identification information and the sheet size detection information stored in the storage unit in association with the plate cylinder identification information.

In another aspect of the present invention, a stencil printing apparatus has a plate cylinder that can be attached to and detached from an apparatus main body freely and a pressing device provided so as to be free to contact and separate from the plate cylinder. During duplex printing, a rear surface printing step is performed after a front surface printing step, and simplex printing can be performed alternately by wrapping a duplex master formed with a first engraved image and a second engraved image in a length direction thereof around the plate cylinder during duplex printing, and wrapping a simplex master formed with a third engraved image for simplex printing around the plate cylinder during simplex printing. The stencil printing apparatus comprises a storage unit for storing master identification information, indicating whether the master is engraved with duplex printing images or a simplex printing image during engraving, and sheet size information corresponding to the master identification information, in association with plate cylinder identification information; a plurality of sheet feeding units for feeding sheets; and a plurality of sheet size detecting devices for detecting the size of the sheets in each of the sheet feeding units. When at least plate cylinder identification information obtained anew when an operation command or a plate cylinder attachment/detachment command is input into the apparatus and sheet size detection information from each of the sheet size detecting device differ from the master identification information and the sheet size detection information stored in the storage unit, a sheet feeding operation by a sheet feeding unit in which different sheet size information has been detected is prohibited.

BRIEF DESCRIPTION OF THE DRAWINGS

The above and other objects, features, and advantages of the present invention will become more apparent from the following detailed description taken with the accompanying drawings, in which.

DESCRIPTION OF THE PREFERRED EMBODIMENTS

A stencil printing apparatus according to each embodiment of the present invention will be described below using the drawings.

Figure 1:
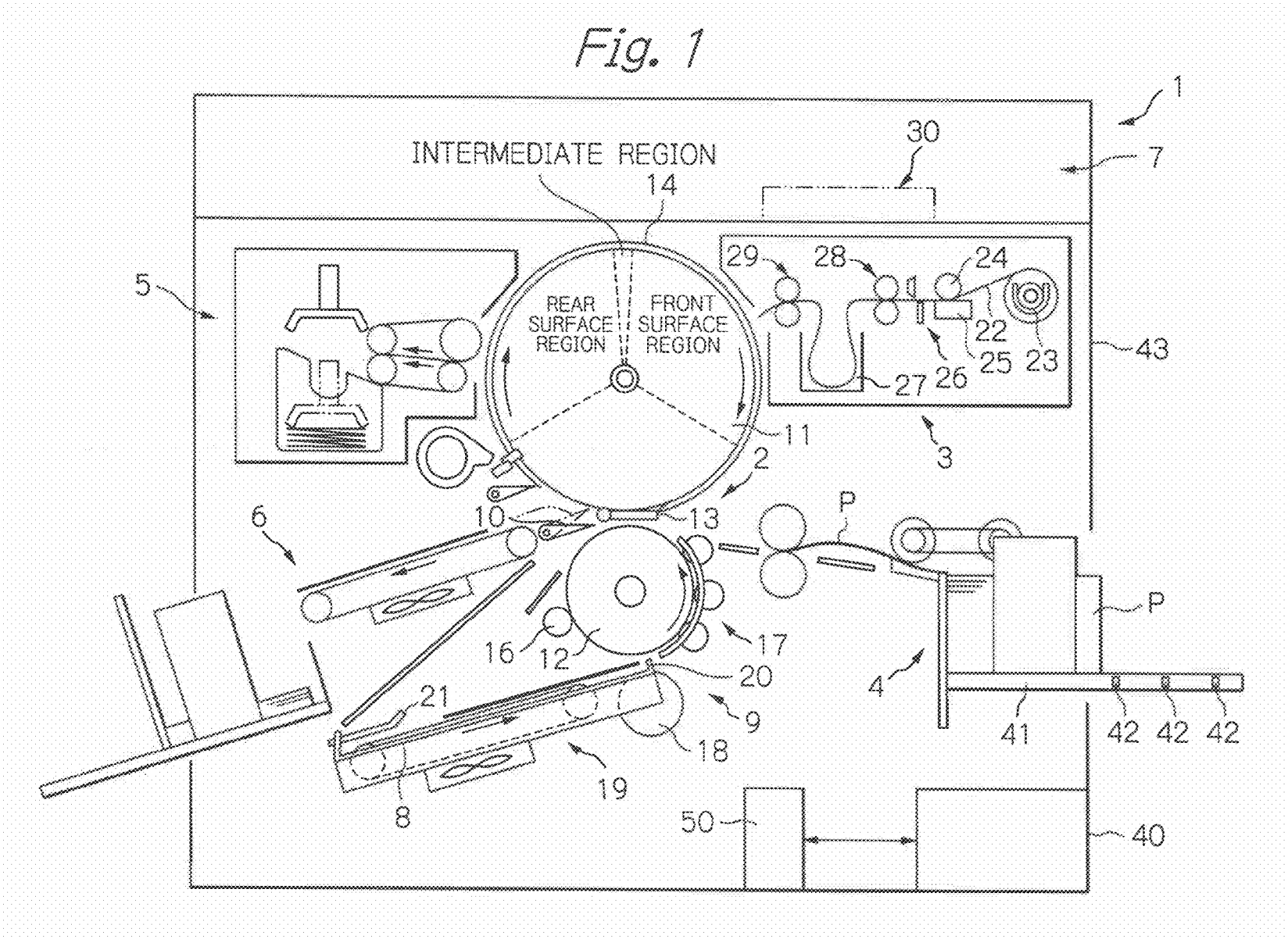
FIG. 1 is a front view showing the schematic constitution of a stencil printing apparatus to which first through fourth embodiments of the present invention can be applied.

As shown in FIG. 1, a stencil printing apparatus 1 comprises a printing unit 2, an engraving unit 3, a sheet feeding unit 4, a plate discharge unit 5, a sheet discharge unit 6, an image reading unit 7, an auxiliary tray 8, sheet re-feeding means 9, a switching member 10, control means 40, and so on.

The printing unit 2, which is disposed substantially in the center of an apparatus main body 43, comprises a printing drum 11 serving as a plate cylinder, and a press roller 12 serving as pressing means. The printing drum 11 is supported on the apparatus main body 43 detachably and rotatably, and is driven to rotate by printing drum driving means, not shown in the drawing. An openable clamper 13 is provided on the outer peripheral surface of the printing drum 11. During duplex printing, a duplex master 14 engraved by the engraving unit 3 is wrapped around the outer peripheral surface of the printing drum 11, and during simplex printing, a simplex master 15 engraved by the engraving unit 3 is wrapped around the outer peripheral surface of the printing drum 11. A rotary encoder, not shown in the drawing, for detecting the position of the printing drum 11 is provided near the outer peripheral surface of the printing drum 11. In this embodiment, the simplex master 15, which is capable of printing a sheet P with a maximum size of A3, is wrapped around the printing drum 11.

Figure 2:
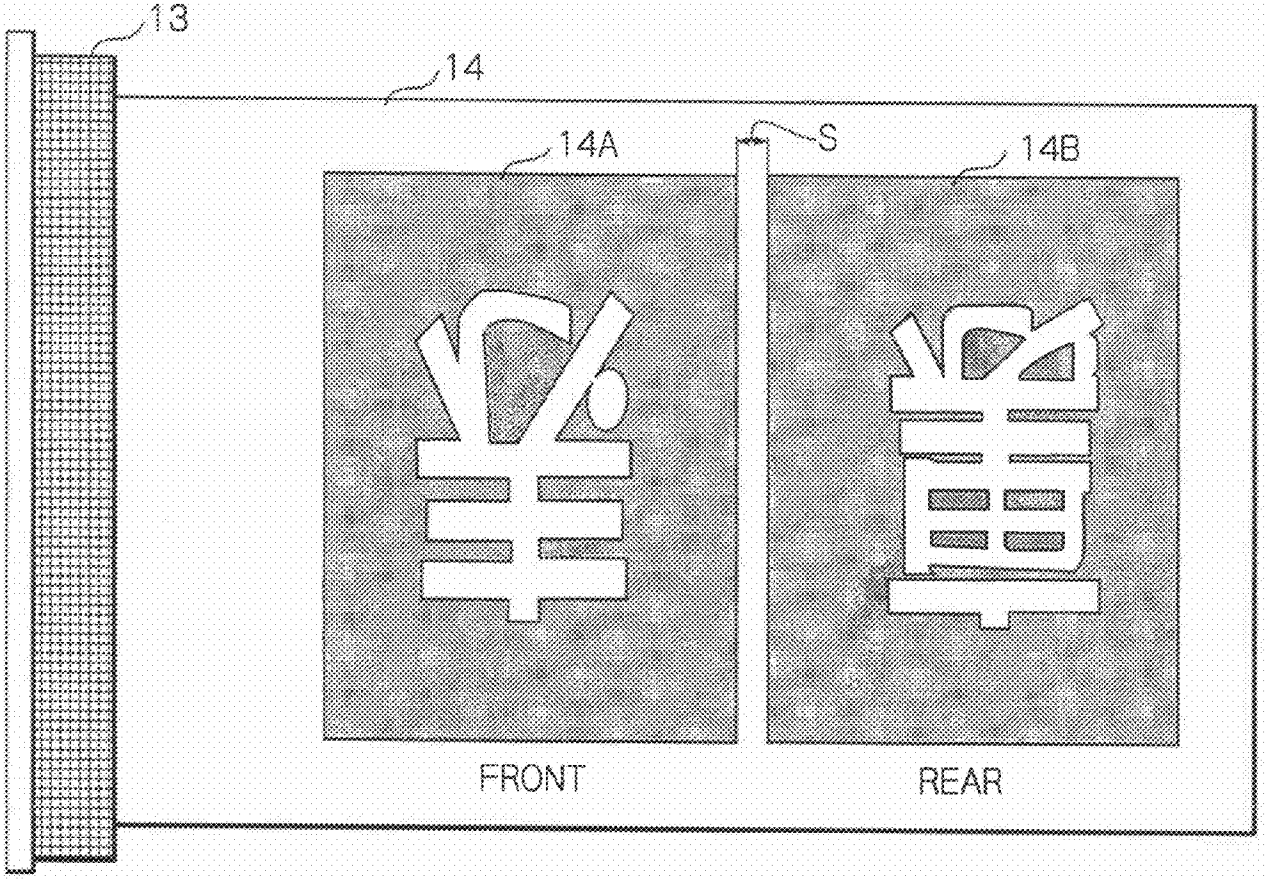
FIG. 2 is a view showing a master engraved with duplex printing images, which is used in each embodiment of the present invention.

As shown in FIG. 2, a first engraved image 14A corresponding to a front surface image and a second engraved image 14B corresponding to a rear surface image are formed on the duplex master 14, and a non-engraved part S is formed between the engraved images 14A, 14B. The duplex master 14 is wrapped around the printing drum 11 such that the first engraved image 14A corresponds to a front surface region shown in FIG. 1, the second engraved image 14B corresponds to a rear surface region shown in FIG. 1, and the non-engraved part S corresponds to an intermediate region shown in FIG. 1. In this embodiment, images that can be printed onto a sheet P having a maximum size of A4 lateral (assuming that the short direction of the sheet is the sheet conveyance direction) are created as the first engraved image 14A and second engraved image 14B.

Figure 3:
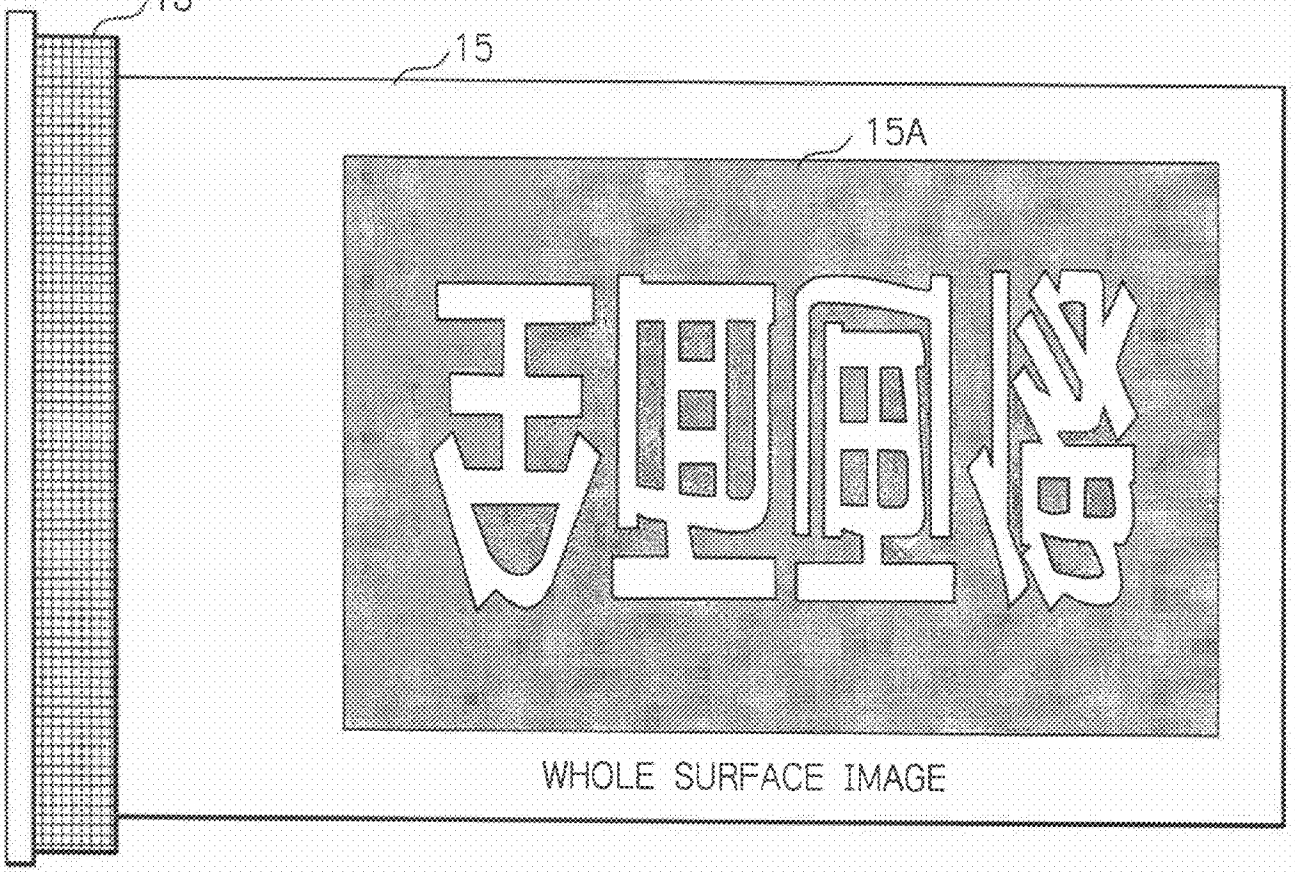
FIG. 3 is a view showing a master engraved with a simplex printing image, which is used in each embodiment of the present invention.

As shown in FIG. 3, a third engraved image 15A corresponding to a simplex printing image is formed on the simplex master 15. The simplex master 15 is wrapped around the printing drum 11 such that the third engraved image 15A corresponds to a range encompassing the front surface region, rear surface region, and intermediate region shown in FIG. 1. In this embodiment, an image that can be printed onto a sheet P having a maximum size of A3 is created as the third engraved image 15A.

The press roller 12 is disposed below the printing drum 11. The press roller 12, which is constituted by a water-repellent elastic body made of fluorine resin or the like, is supported rotatably on an arm member, not shown in the drawing, at either end, while the arm member, not shown in the drawing, is supported so as to be swingable by swinging means, not shown in the drawing. The press roller 12 selectively occupies a removed position shown in FIG. 1, in which the peripheral surface thereof is removed from the printing drum 11, and a pressing position, in which the peripheral surface thereof is pressed against the duplex master 14 on the printing drum 11.

The swinging means, not shown in the drawing, are constituted such that a pressing range of the press roller 12 relative to the printing drum 11 can be switched between a first range covering all of the front surface region, intermediate region, and rear surface region shown in FIG. 1, a second range matching the front surface region, and a third range covering a downstream side part of the front surface region, the intermediate region, and the rear surface region. A cleaning roller 16 which performs cleaning by contacting the peripheral surface of the press roller 12 is disposed near the peripheral surface of the press roller 12. The cleaning roller 16 is driven to rotate by driving means, not shown in the drawing.

A sheet re-feeding guidance member 17 for conveying the sheet P, which has been delivered from the sheet re-feeding means 9 and printed on the front surface thereof, along the peripheral surface of the press roller 12 is disposed near the right side of the press roller 12. A sheet re-feeding resist roller 18 for feeding the sheet P from the auxiliary tray 8 such that the sheet P contacts the peripheral surface of the press roller 12 is disposed below the press roller 12. A sheet re-feeding conveyance unit 19 having the auxiliary tray 8 on its upper surface is disposed below, and to the left of, the press roller 12, and is formed integrally with a sheet re-feeding positioning member 20. A sheet receiving plate 21 is disposed above the sheet re-feeding conveyance unit 19 so as to be free to move along the upper surface of the auxiliary tray 8. The auxiliary tray 8, sheet re-feeding guidance member 17, sheet re-feeding resist roller 18, sheet re-feeding positioning member 20, sheet re-feeding conveyance unit 19, and sheet receiving plate 21 together constitute the sheet re-feeding means 9.

The switching member 10 is disposed to the left of the contact position between the printing drum 11 and the press roller 12, and above the conveyance path of the sheet P. The switching member 10 is supported rotatably on the apparatus main body 43 by an end portion thereof on the downstream side of the sheet conveyance direction, and is moved by moving means, not shown in the drawing, so as to selectively occupy a first position, shown by the solid line in FIG. 1, and a second position, shown by the dot-dot-dash line. When the sheet P passes between the printing drum 11 and press roller 12 and the switching member 10 occupies the first position, the sheet P is guided to the sheet discharge unit 6. When the switching member 10 occupies the second position, the sheet P is guided to the auxiliary tray 8.

The engraving unit 3 is disposed above, and to the right of, the printing unit 2. The engraving unit 3 has a well-known constitution comprising a master holding member 23 for holding a master roll on which a master 22 is wound in roll-form, a platen roller 24, a thermal head 25, master switching means 26, a master stock unit 27, a tension roller pair 28, a reverse roller pair 29, and so on. In the engraving unit 3, the duplex master 14 is created during duplex printing and the simplex master 15 is created during simplex printing.

The sheet feeding unit 4 is disposed below the engraving unit 3. The sheet feeding unit 4 has a well-known constitution comprising a sheet feeding tray 41 carrying the sheet P, a sheet feeding roller, a separating roller, a separating pad, a resist roller pair, and so on. A plurality of sheet size detection sensors 42 serving as sheet size detecting means for detecting the size of the sheet P carried on the upper surface of the sheet feeding tray 41 are disposed on the sheet feeding tray 41.

The plate discharge unit 5 disposed above, and to the left of, the printing unit 2 also has a well-known constitution comprising an upper plate discharge member, a lower plate discharge member, a plate discharge box, a compression plate, and so on. Used duplex masters 14 and simplex masters 15 are peeled away from the outer peripheral surface of the printing drum 11 and disposed of in the interior of the plate discharge box.

The sheet discharge unit 6 is disposed below the plate discharge unit 5. The sheet discharge unit 6 has a well-known constitution comprising a peeling pawl, a sheet discharge conveyance unit, a sheet discharge tray, a peeling fan, and so on. The sheet P is peeled away from the outer peripheral surface of the printing drum 11 and discharged onto the sheet discharge tray.

The image reading unit 7 is disposed in the upper portion of the apparatus main body 43. Although not shown in the drawings, the image reading unit 7 comprises a contact glass on which an original is placed, a pressure plate provided so as to be free to contact and separate from the contact glass, a reflection mirror and a fluorescent lamp for scanning and reading an original image, a lens for condensing the scanned image, an image sensor for processing the condensed image, and so on.

Figure 4:
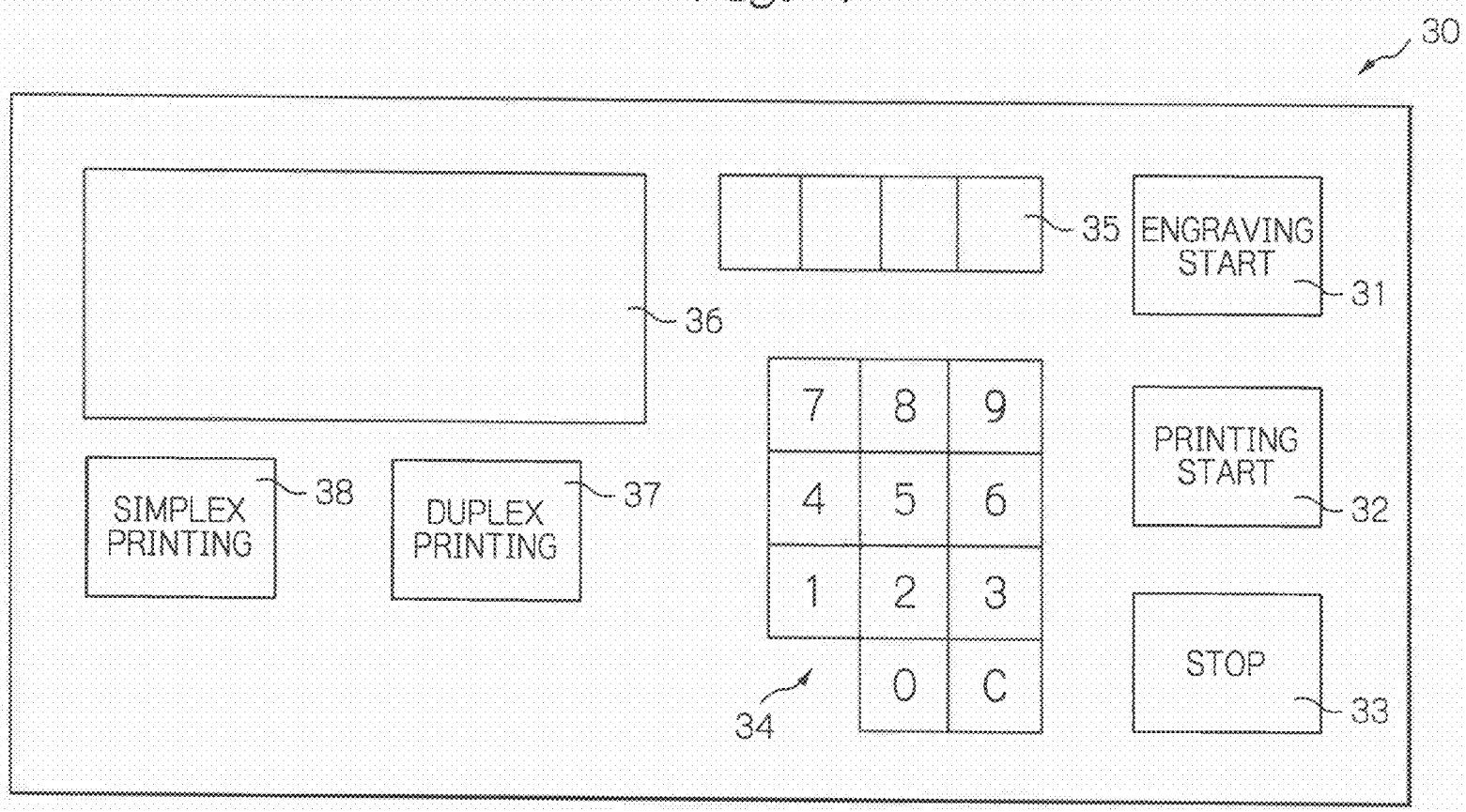
FIG. 4 is a view showing the schematic constitution of an operating panel used in each embodiment of the present invention.

FIG. 4 shows an operating panel 30 serving as an operating unit of the stencil printing apparatus 1. In the drawing, the operating panel 30 has a well-known constitution comprising an engraving start key 31, a printing start key 32, a stop key 33, a numeric keypad 34, a display apparatus 35 constituted by a seven segment LED, a display apparatus 36 constituted by an LCD, and soon, and is also provided with a duplex printing key 37 that is depressed when performing duplex printing, and a simplex printing key 38 that is depressed when performing simplex printing.

Figure 5:
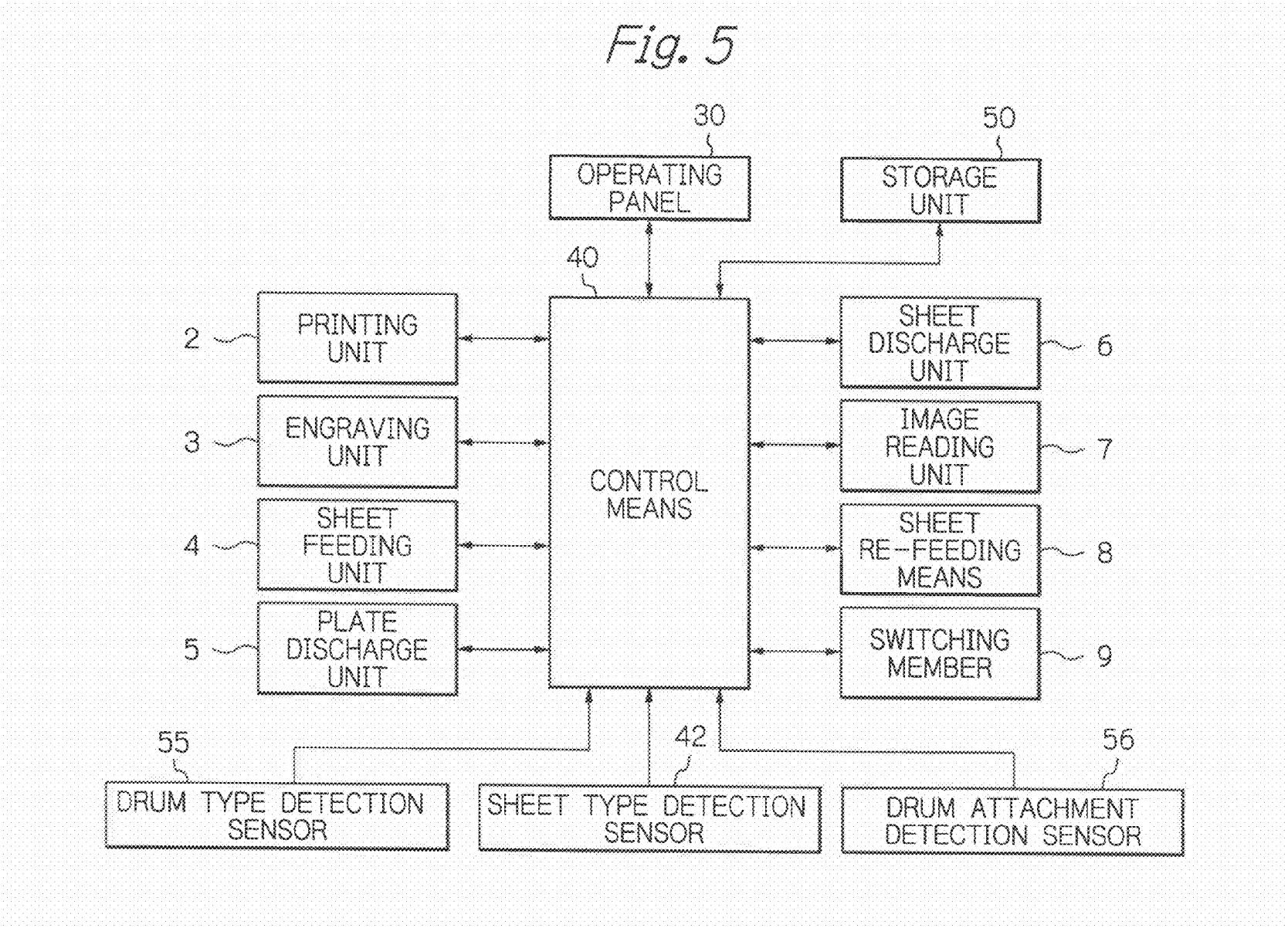
FIG. 5 is a block diagram showing the constitution of control means used in the first, second, fourth, and fifth embodiments of the present invention.

FIG. 5 is a block diagram of the control means 40 used in the stencil printing apparatus 1. In the drawing, the control means 40 are constituted by a well-known computer comprising in its interior a CPU, ROM, RAM, a timer, and so on. The control means 40 control the respective operations of the printing unit 2, engraving unit 3, paper feeding unit 4, plate discharge unit 5, sheet discharge unit 6, image reading unit 7, sheet re-feeding means 9, and switching member 10 on the basis of operation commands (signals) from a rotary encoder, not shown in the drawing, and the operating panel 30.

The apparatus main body 43 comprises a storage unit 50 storing master identification information for differentiating between the duplex master 14, which is engraved with duplex printing images during engraving, and the simplex master 15, which is engraved with a simplex printing image during engraving, in association with information relating to each printing drum that is attached to the apparatus main body 43 during engraving. The apparatus main body 43 is provided with a drum type detection sensor 55 for detecting an ink color and a drum size serving as information relating to the type of the attached printing drum 11, and a drum attachment detection sensor 56 for detecting the attachment/detachment state of the printing drum 11. The drum type detection sensor 55 detects the printing drum size and the ink color used by the printing drum 11 from an information recording unit such as a barcode attached to a side plate, not shown in the drawing, of the printing drum 11, for example. The drum attachment detection sensor 56 may be a limit switch disposed on the back side of the apparatus main body 43, which switches ON when the printing drum is attached and OFF when the printing drum is detached, for example. The storage unit 50, drum type detection sensor 55, drum attachment detection sensor 56, and sheet size detection sensor 42 are connected to the control means 40 by a signal line such that the respective detection signals thereof are input into the control means 40. The control means 40 comprise an energy saving mode for halting various operations of the apparatus when no command is issued to the apparatus for a predetermined length of time, and when the control means 40 enter this mode, the apparatus enters a state of rest. When an operation command is input in relation to the apparatus, the energy saving mode is terminated and the control means 40 control the various units to switch the apparatus from a state of rest to an activated state.

An operation of the stencil printing apparatus 1 when duplex printing is performed by pressing the duplex printing key 37 will be described below on the basis of the above constitution.

When an original is set on the image reading unit 7 and the duplex printing key 37 is pressed by an apparatus operator, the fact that duplex printing has been set is stored by the control means 40, and a duplex printing operating program is accessed. Then, when the apparatus operator presses the engraving start key 31, an original image reading operation is performed in the image reading unit 7, and the plate discharge unit 5 is activated such that the used duplex master 14 or simplex master 15 is peeled away from the outer peripheral surface of the printing drum 11. Following plate discharge, the first engraved image 14A and second engraved image 14B are formed on the master 22 by activating the engraving unit 3, whereby a new duplex master 14 is engraved, and the new duplex master 14 is wrapped around the printing drum 11.

When the wrapping operation is complete and the stencil printing apparatus 1 has entered a state of duplex printing standby, various printing conditions are set. Then, when the apparatus operator presses the printing start key 32, the printing drum 11 is driven to rotate at a set speed, and one sheet P is separated from the other sheets P and fed by the sheet feeding unit 4. The fed sheet P is halted temporarily by the resist roller pair, and then conveyed between the printing drum 11 and press roller 12 at a predetermined timing. Note that the various printing conditions may be set before pressing the engraving start key 31.

When the printing drum 11 has rotated to a predetermined angle such that the front surface region thereof occupies a predetermined position corresponding to the press roller 12, the press roller 12 occupies the pressing position, and therefore the sheet P is pressed against the first engraved image 14A of the duplex master 14 on the printing drum 11. As a result, a front surface image is transferred onto one side of the sheet P. At this time, the swinging means, not shown in the drawing, for swinging the press roller 12 set the pressing range of the press roller 12 relative to the printing drum 11 to the second range.

When front surface printing is complete, the sheet P is peeled away from the outer peripheral surface of the printing drum 11 by the tip end of the switching member 10, which occupies the second position, and is conveyed to the sheet re-feeding conveyance unit 19. At this time, the tip end of the sheet P is received by the sheet receiving plate 21, and hence the sheet P is placed on the auxiliary tray 8 from the rear end side. The sheet P on the auxiliary tray 8 is then conveyed in the direction of the arrow in FIG. 1 by the sheet re-feeding conveyance unit 19 and held temporarily with the tip end thereof abutting against the sheet re-feeding positioning member 20.

While the first sheet P is guided onto the auxiliary tray 8, the printing drum 11 continues to rotate, and at the same timing as the first sheet P, a second sheet P is fed from the sheet feeding unit 4. At this time, the swinging means, not shown in the drawing, set the pressing range of the press roller 12 relative to the printing drum 11 to the first range. Similarly to the first sheet P, the front surface image is transferred onto one side of the second fed sheet P by the press roller 12, whereupon the second sheet P is conveyed to the sheet re-feeding conveyance unit 19 by the switching member 10, which occupies the second position.

After the second sheet P has been fed from the sheet feeding unit 4, the sheet re-feeding resist roller 18 is activated at a slightly earlier timing than the timing at which the rear surface region of the printing drum 11 reaches the position corresponding to the press roller 12, whereby the first sheet P stored on the auxiliary tray 8 is pressed against the peripheral surface of the press roller 12. The first sheet P pressed against the peripheral surface of the press roller 12 is conveyed toward a position of contact with the printing drum 11 by the rotational force of the press roller 12, which is rotated by being pressed against the printing drum 11, and when the first sheet P is pressed against the second engraved image 14B on the duplex master 14, a rear surface image is transferred onto the other side thereof.

When the rear surface image has been transferred onto the first sheet P such that duplex printing thereof is complete, the first sheet P is guided to the sheet discharge unit 6 by the switching member 10 occupying the first position. The tip end portion of the first sheet P is lifted by a blast of air from the peeling fan, whereupon the sheet P is peeled away from the outer peripheral surface of the printing drum 11 by the tip end of the peeling pawl. Having been peeled away, the printed sheet P is conveyed to the sheet discharge conveyance unit and discharged onto the sheet discharge tray. The operation described above is repeated until a set number of sheets to be printed has been exhausted. After the final sheet P has been guided onto the auxiliary tray 8, the swinging means, not shown in the drawing, set the pressing range of the press roller 12 relative to the printing drum 11 to the third range, and once a duplex printing operation has been performed for the set number of sheets, operations at each site are halted.

Next, an operation of the stencil printing apparatus 1 when normal simplex printing is performed by pressing the simplex printing key 38 will be described.

When an original is set on the image reading unit 7 and the apparatus operator presses the simplex printing key 38, the fact that simplex printing has been set is stored by the control means 40, and a simplex printing operating program is accessed. Then, when the apparatus operator presses the engraving start key 31, an original image reading operation is performed in the image reading unit 7, and the plate discharge unit 5 is activated such that the used duplex master 14 or simplex master 15 is peeled away from the outer peripheral surface of the printing drum 11. Following plate discharge, the third engraved image 15A is formed on the master 22 by activating the engraving unit 3, whereby a new simplex master 15 is engraved, and the new simplex master 15 is wrapped around the printing drum 11.

When the wrapping operation is complete and the stencil printing apparatus 1 has entered a state of simplex printing standby, various printing conditions are set. Then, when the apparatus operator presses the printing start key 32, the printing drum 11 is driven to rotate at a set speed, and one sheet P is separated from the other sheets P and fed by the sheet feeding unit 4. The fed sheet P is halted temporarily by the resist roller pair, and then conveyed between the printing drum 11 and press roller 12 at a predetermined timing.

When the printing drum 11 has rotated to a predetermined angle such that the front surface region thereof occupies a position corresponding to the press roller 12, the press roller 12 occupies the pressing position, and therefore the sheet P is pressed against the third engraved image 15A of the simplex master 15 on the printing drum 11. As a result, an image is transferred onto the sheet P. At this time, the swinging means, not shown in the drawing, for swinging the press roller 12 set the pressing range of the press roller 12 relative to the printing drum 11 to the first range.

When the image has been transferred onto the sheet P such that printing thereof is complete, the sheet P is guided to the sheet discharge unit 6 by the switching member 10 occupying the first position. The tip end portion of the sheet P is lifted by a blast of air from the peeling fan, whereupon the sheet P is peeled away from the outer peripheral surface of the printing drum 11 by the tip end of the peeling pawl. Having been peeled away, the printed sheet P is conveyed to the sheet discharge conveyance unit and discharged onto the sheet discharge tray. The operation described above is repeated until a set number of sheets to be printed has been exhausted. Once a simplex printing operation has been performed for the set number of sheets, operations at each site are halted.

Next, embodiments of the control performed by the control means 40 will be described in sequence. The hardware constitution of the control means 40 is identical in each embodiment, and therefore, in the following description, identical reference numerals are allocated thereto. Further, when using flowcharts to describe the embodiments, the description of steps having an identical content will be limited to the first embodiment, and duplicate detailed description of these identical steps will be omitted.

First Embodiment

In this embodiment, a duplex printing mode or a simplex printing mode is selected on the basis of printing drum identification information detected (obtained) anew by the drum type detection sensor 55 when various apparatus operation commands are input into the control means 40 from the operating panel 30 or a printing drum attachment/detachment command is input from the drum attachment detection sensor 56, and master identification information stored in the storage unit 50.

Figure 6:
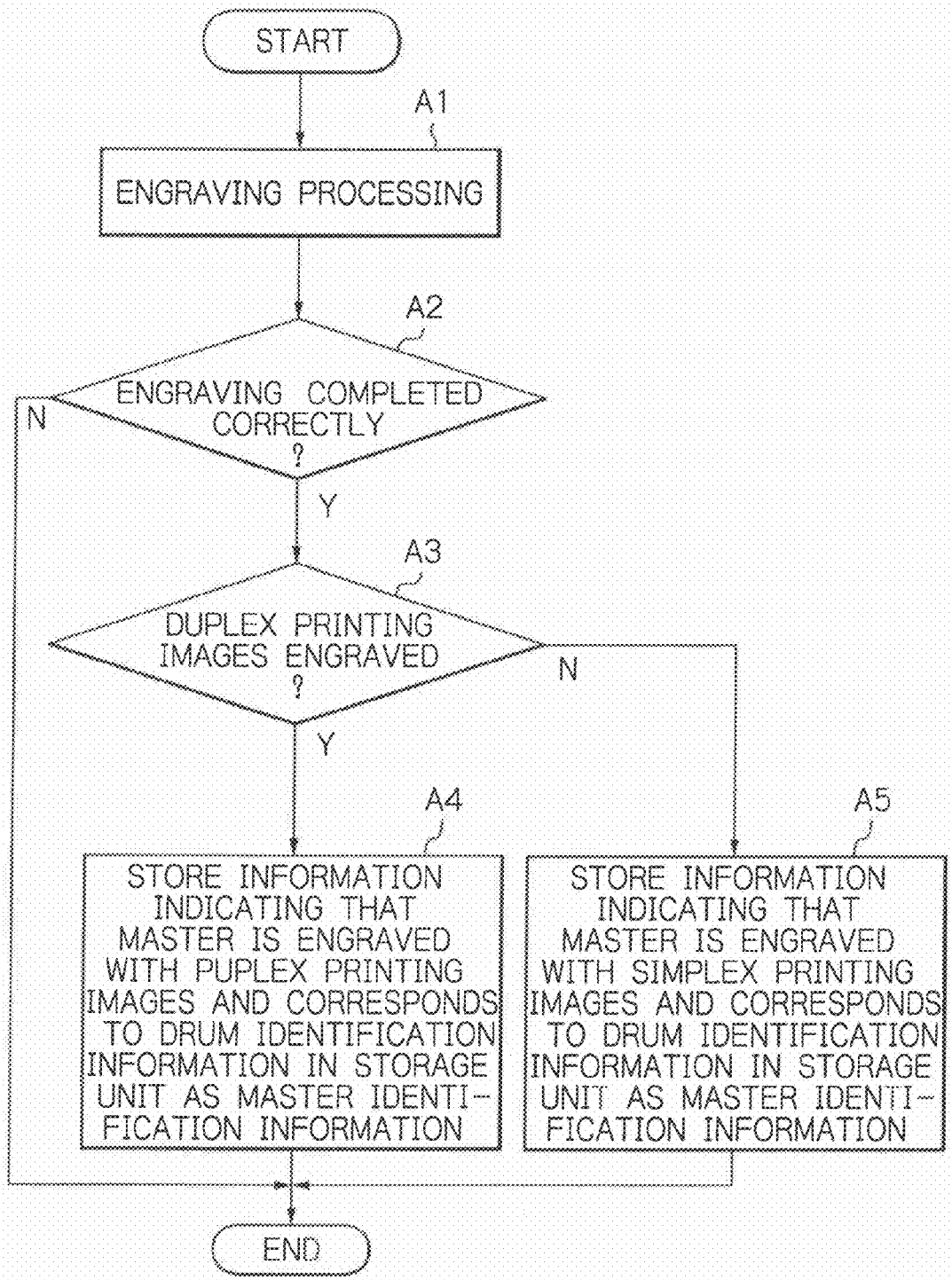
FIG. 6 is a flowchart showing an aspect of master identification information storage processing in the first embodiment.

Master identification information indicating whether the master is the duplex master 14 or the simplex master 15 is stored in the storage unit 50 by means of master identification information storage processing, an example of which is shown in FIG. 6. When engraving processing is executed in a step A1 of FIG. 6, a determination is made in a step A2 as to whether or not engraving has been completed correctly according to a signal from a well-known master jam detection sensor, not shown in the drawing, provided in the engraving unit 3, for example. When engraving has not been completed correctly, the storage processing ends, and when engraving has been completed correctly, the routine advances to a step A3. In the step A3, a determination as to whether or not duplex printing images have been engraved is made using an image signal of the engraving. When duplex printing images have been engraved, the routine advances to a step A4, and when duplex printing images have not been engraved, it is assumed that a simplex printing image has been engraved, and the routine advances to a step A5.

In the step A4, a signal from the drum identification detecting means 55 is stored in a storage area 50A of the storage unit 50 corresponding thereto in association with information indicating that the master has been engraved with duplex printing images (i.e. that the master is the duplex master 14). In the step A5, a signal from the printing drum identification detecting means 55 is stored in a storage area 50B of the storage unit 50 corresponding thereto in association with information indicating that the master has been engraved with a simplex printing image (i.e. that the master is the simplex master 15). The processing is then terminated.

Figure 7:
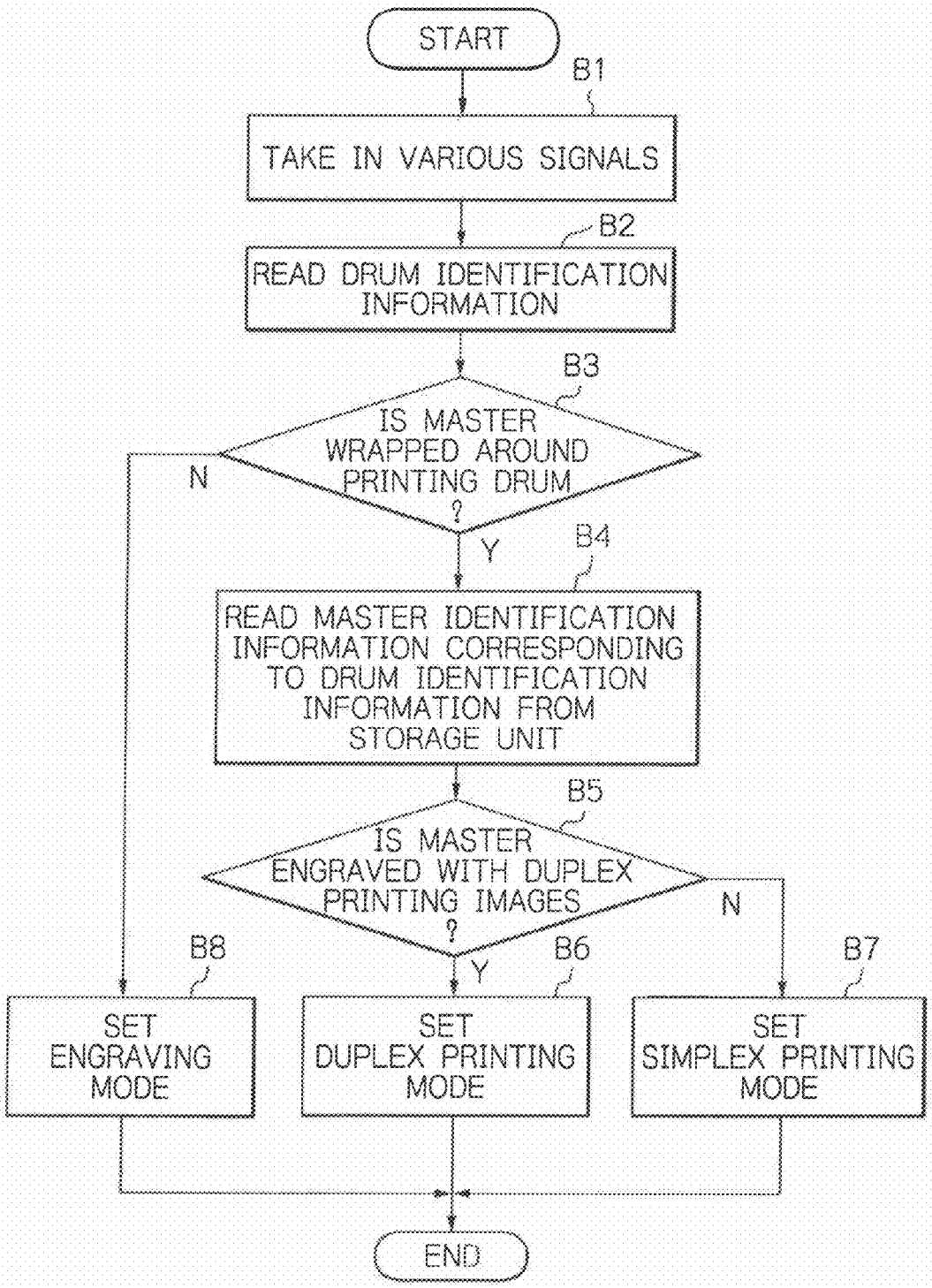
FIG. 7 is a flowchart showing an aspect of master determination processing in the first embodiment.

The control means 40 execute master determination processing shown in FIG. 7. In a step B1 of FIG. 7, signals generated when the various switches of the operating panel 30 are operated and a signal from the drum attachment detecting means 56 are taken in, and in a step B2, a printing drum identification signal is read from the printing drum 11 attached to the apparatus main body 43 by the drum identification detecting means 55. In a step B3, a determination as to whether or not the master is wrapped around the printing drum 11 is made according to the output of a well-known optical sensor, not shown in the drawing, provided on the peripheral portion of the printing drum. When the master is wrapped around the printing drum 11, the routine advances to a step B4, and when the master is not wrapped around the printing drum 11, the routine advances to a step B8, where an engraving mode is set. Since the printing drum 11 can be attached to and detached from the apparatus main body 43 freely, the printing drum 11 may be detached from the apparatus main body 43 and replaced with a different printing drum 11 during multi-color printing, and new printing may also be performed. Here, in consideration of a case in which new printing is executed, the engraving mode is set so that engraving can be executed in preparation for the new image printing operation. In this case, the control means 40 control an operation of the engraving unit 3 in accordance with image signals to engrave either the duplex master 14 or simplex master 15 in the manner described above.

In the step B3, when the master is wrapped around the printing drum 11, the routine advances to the step B4, where master identification information corresponding to the drum identification information is read from the storage unit 50. The routine then advances to a step B5. In the step B5, a determination is made as to whether or not the read master identification information indicates a master (the duplex master 14) engraved with duplex printing images. When the master is engraved with duplex printing images (i.e. when the master is the duplex master 14), the routine advances to a step B6, where the duplex printing mode is set. When the master is not engraved with duplex printing images (i.e. when the master is not the duplex master 14), it is determined that the master is engraved with a simplex printing image (i.e. that the master is the simplex master 15), and therefore the routine advances to a step B7, where the simplex printing mode is set. The control is then terminated. When the duplex printing mode or simplex printing mode is set, the control means 40 execute the corresponding printing by controlling the various units. More specifically, when the power is switched on, low energy mode or the like is switched to normal mode, or the drum is replaced, the control means 40 refer to the drum identification information relating to the printing drum 11 currently attached to the apparatus main body 43, access the information recorded in association with the drum identification information during engraving from the storage area 50A or the storage area 50B of the storage unit 50, and switch between the duplex printing mode and simplex printing mode automatically in accordance with the content of the information (whether the master is engraved with duplex printing images or a simplex printing image).

Figure 8A:
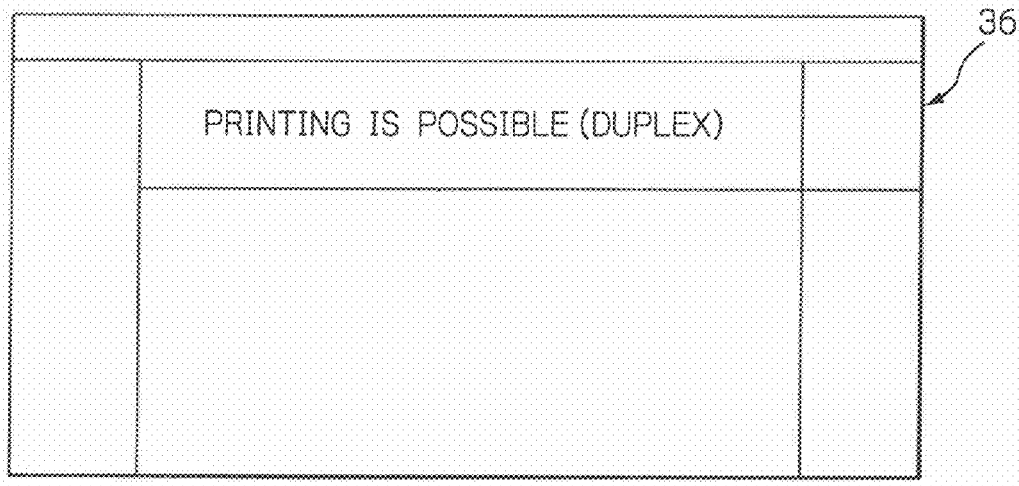
FIGS. 8A and 8B are enlarged views showing examples of guidance information displayed by display means in the first embodiment.
Figure 8B:
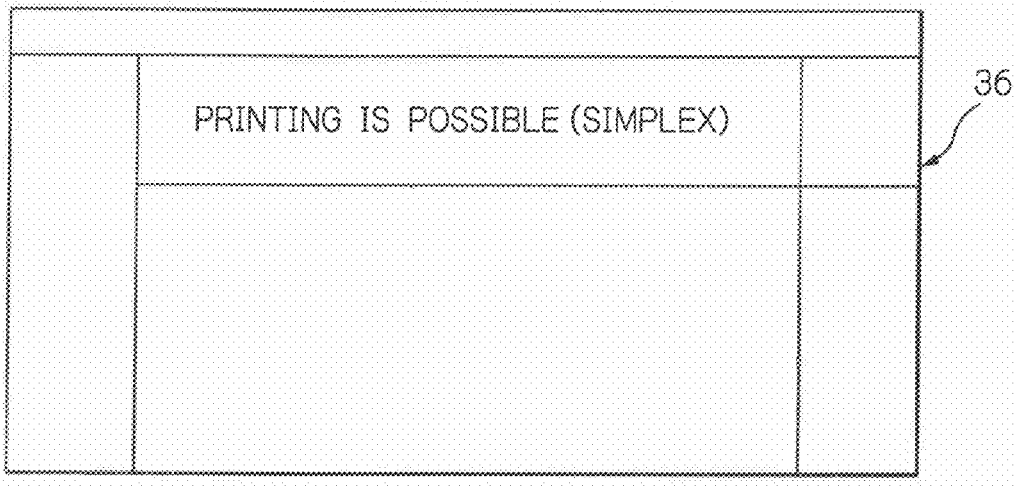

The control means 40 display guidance on the LCD display apparatus 36 of the operating panel 30 as means for informing the apparatus operator of whether the duplex printing mode or simplex printing mode has been set. In the duplex printing mode, this guidance is displayed as "printing is possible (duplex)", as shown in FIG. 8A, and when the simplex printing mode is set, the guidance is displayed as "printing is possible (simplex)", as shown in FIG. 8B.

Hence, the duplex printing mode or simplex printing mode is selected by the control means 40 on the basis of the drum identification information, which is obtained anew during input of an operation command to the apparatus or an attachment/detachment command relating to the printing drum 11, and the master identification information stored in the storage unit 50. Therefore, situations in which the master breaks or ink adheres to the press roller 12 when simplex printing is performed mistakenly using the duplex master 14 or duplex printing is performed mistakenly using the simplex master 15 can be prevented, and master consumption due to re-engraving during duplex printing can be suppressed.

Second Embodiment

In this embodiment, the master identification information is displayed on the LCD display apparatus 36 serving as display means on the basis of printing drum identification information detected (obtained) anew by the drum type detection sensor 55 when various apparatus operation commands are input into the control means 40 from the operating panel 30 or a printing drum attachment/detachment command is input from the drum attachment detection sensor 56, and the master identification information stored in the storage unit 50.

Figure 9:
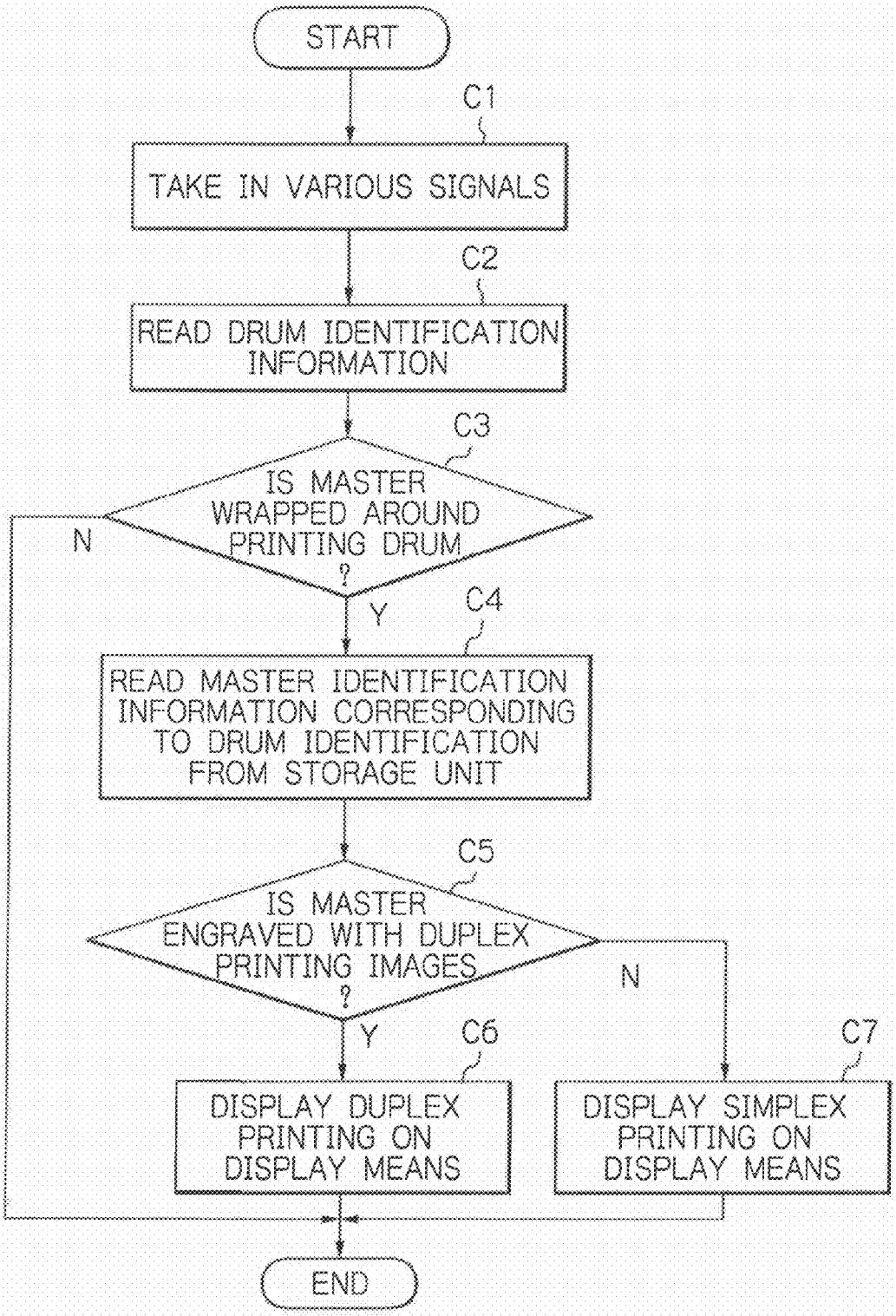
FIG. 9 is a flowchart showing an aspect of master identification information display processing in the second embodiment.

This master identification information display processing will be described using the flowchart in FIG. 9. Note that steps C1 to C5 in FIG. 9 are identical in content to the steps B1 to B5 in FIG. 7, and hence description thereof has been omitted.

In the step C3, when the master is wrapped around the printing drum 11, the routine advances to the step C4, where the master identification information corresponding to the drum identification information is read from the storage unit 50. The routine then advances to the step C5. In the step C5, a determination is made from the read master identification information and the drum identification information detected in the step C2 as to whether or not the master on the drum is the duplex master 14 or the simplex master 15. When the master is the duplex master 14, the routine advances to a step C6, where information indicating duplex printing is displayed on the LCD display apparatus 36 of the operating panel 30, and when the master is not the duplex master 14, it is determined that the master is the simplex master 15, and the routine advances to a step C7*, where information indicating simplex printing is displayed on the LCD display apparatus 36. The control is then terminated.

Figure 10A:
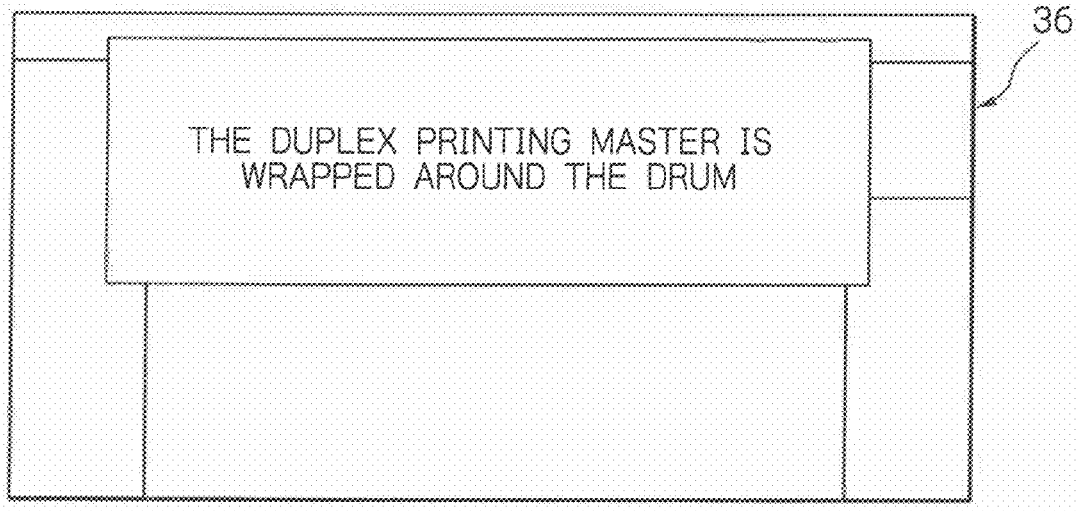
FIGS. 10A and 10B are enlarged views showing examples of display content displayed by display means in the second embodiment.
Figure 10B:
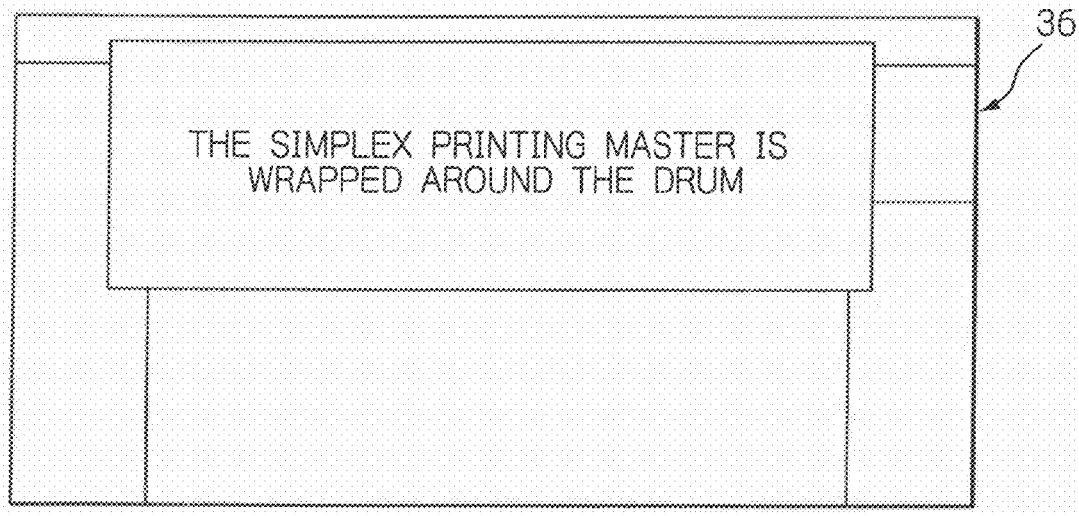

During duplex printing, display such as "the duplex printing master is wrapped around the drum" is displayed, as shown in FIG. 10A, and during simplex printing, display such as "the simplex printing master is wrapped around the drum" is displayed, as shown in FIG. 10B, for example.

By displaying the master identification information indicating whether the master is the duplex printing master or simplex printing master on the LCD display apparatus 36 using the control means 40 on the basis of the drum identification information, which is obtained anew during input of an operation command to the apparatus or an attachment/detachment command relating to the printing drum 11, and the master identification information stored in the storage unit 50, unnecessary engraving can be suppressed, leading to a decrease in master consumption, and the apparatus operator can prepare paper corresponding to the master more easily.

Third Embodiment

Figure 11:
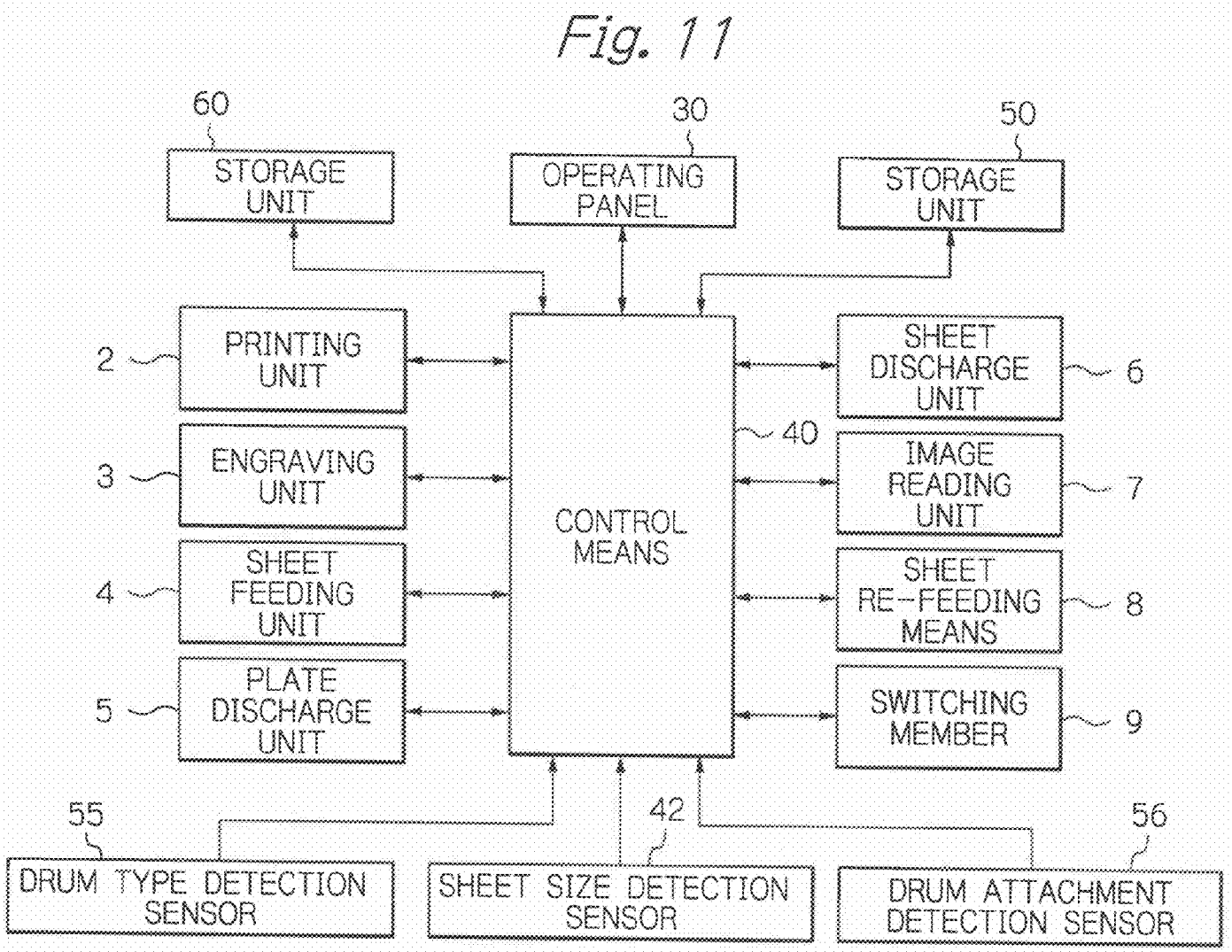
FIG. 11 is a block diagram showing the constitution of control means used in a third embodiment of the present invention.

In this embodiment, a warning operation is executed when the printing drum identification information, which is detected (obtained) anew by the drum type detection sensor 55 when various apparatus operation commands are input into the control means 40 from the operating panel 30 or a printing drum attachment/detachment command is input from the drum attachment detection sensor 56, and the master identification information stored in the storage unit 50 are different. To realize this constitution, a separate storage unit 60 to the storage unit 50 is added to the control system of the embodiment, as shown in FIG. 11. In this embodiment, the master identification information, indicating whether the master is the duplex master 14 or simplex master 15, is stored in the storage unit 50 during engraving, while the storage unit 60 stores master identification information indicating the duplex master 14 or the simplex master 15 from a single engraving operation. Storage processing to the storage units 50, 60 is performed by means of master identification information storage processing, an example of which is shown in FIG. 12.

Figure 12:
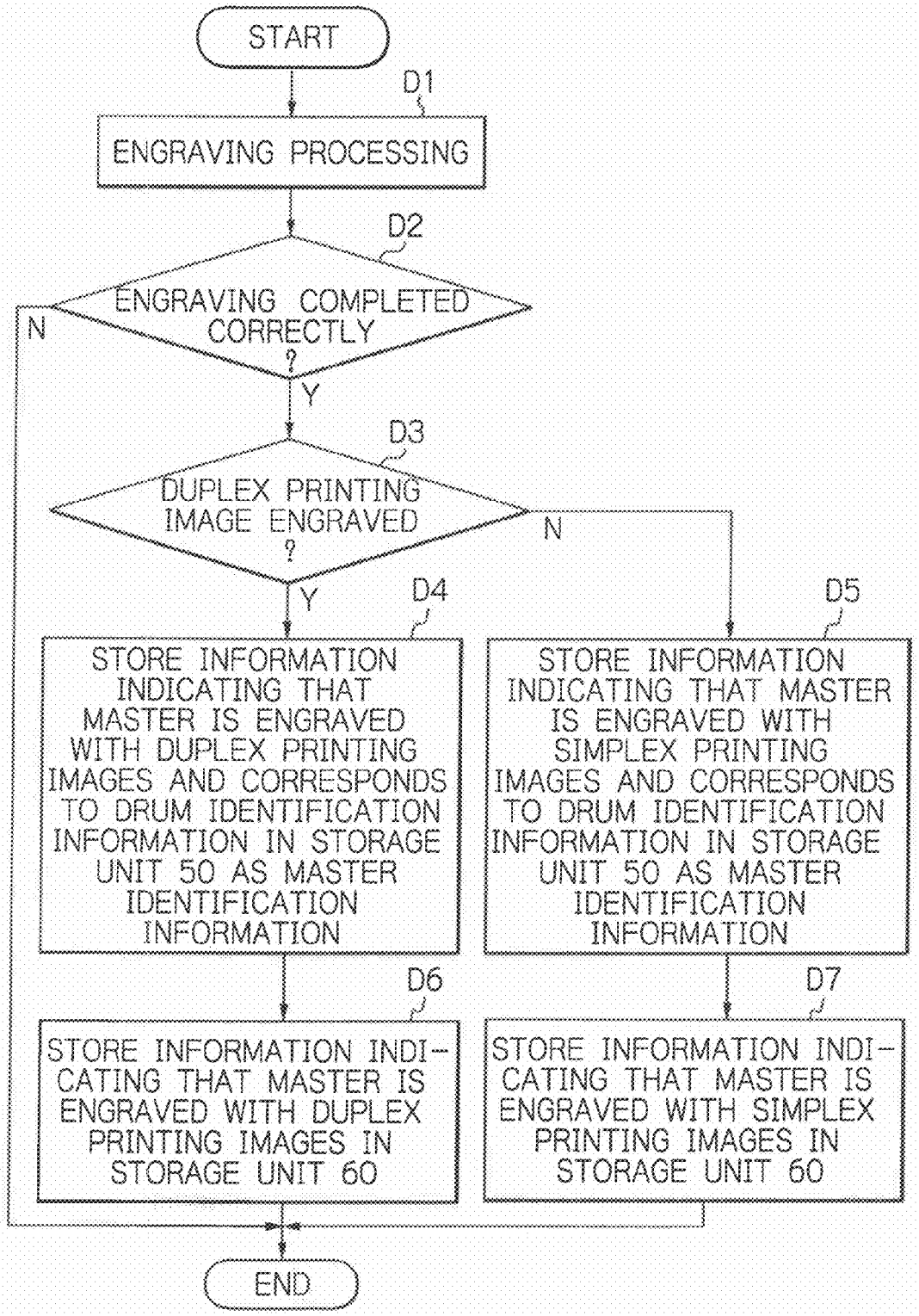
FIG. 12 is a flowchart showing an aspect of master identification information and sheet size information storage processing in the third embodiment.

When engraving processing is executed in a step D1 of FIG. 12, a determination is made in a step D2 as to whether or not engraving has been completed correctly. When engraving has not been completed correctly, the storage processing ends, and when engraving has been completed correctly, the routine advances to a step D3. In the step D3, a determination as to whether or not duplex printing images have been engraved is made using an image signal of the engraving. When duplex printing images have been engraved, the routine advances to a step D4, and when duplex printing images have not been engraved, it is assumed that a simplex printing image has been engraved, and the routine advances to a step D6.

In the step D4, a signal from the drum identification detecting means 55 is stored in the storage unit 50 in association with information indicating that the master has been engraved with duplex printing images (i.e. that the master is the duplex master 14). The routine then advances to a step D5, where information indicating that the master has been engraved with duplex printing images, i.e. that the master is the duplex master 14, is stored in the storage unit 60. The control is then terminated. In the step D6, a signal from the printing drum identification detecting means 55 is stored in the storage unit 50 in association with information indicating that the master has been engraved with a simplex printing image (i.e. that the master is the simplex master 15). The routine then advances to a step D7, where information indicating that the master has been engraved with a simplex printing image, i.e. that the master is the simplex master 15, is stored in the storage unit 60. The control is then terminated.

Figure 13:
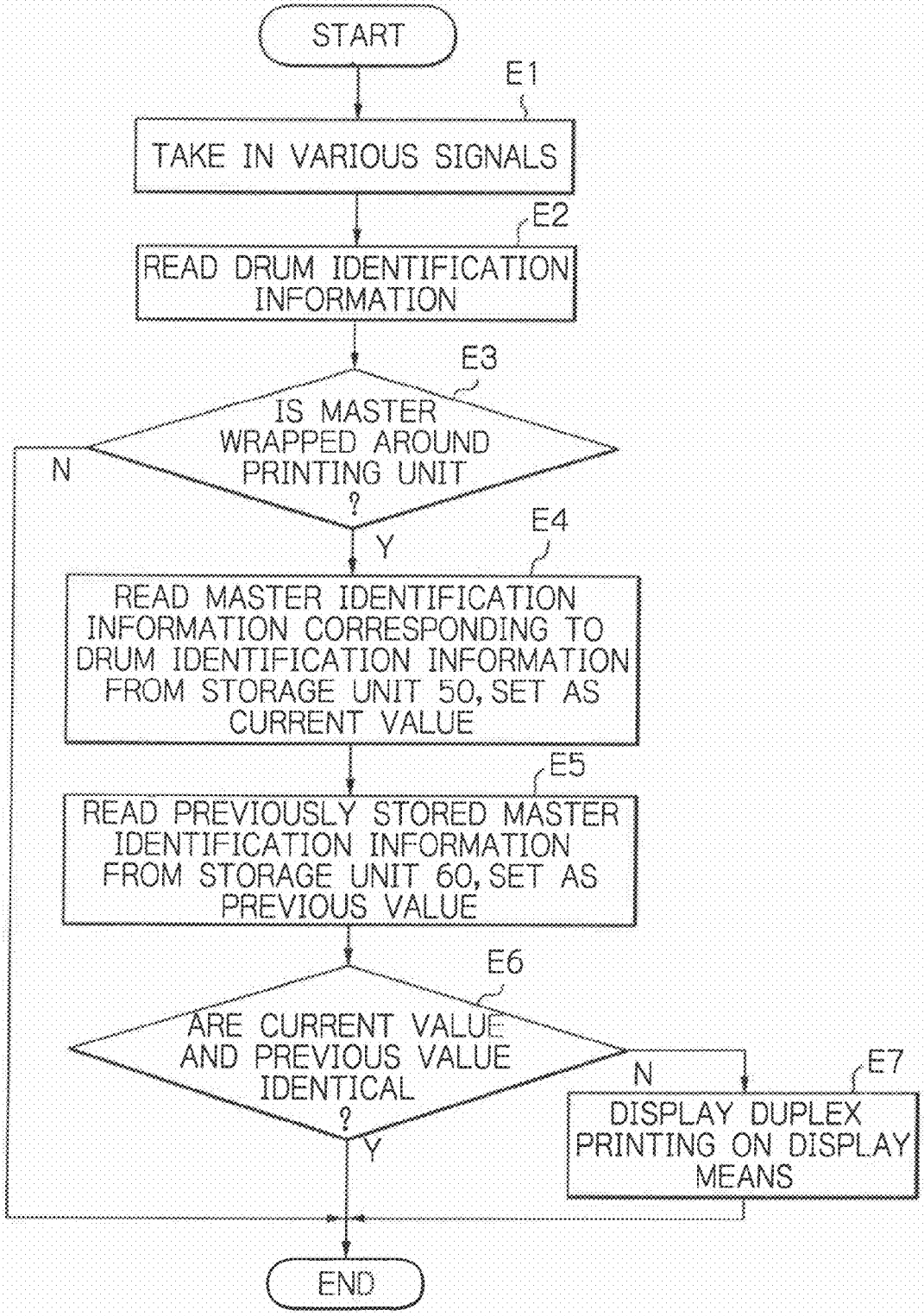
FIG. 13 is a flowchart showing an aspect of warning processing in the third embodiment.

Next, warning processing will be described using the flowchart shown in FIG. 13. Steps E1 to E3 in FIG. 13 are identical in content to the steps B1 to B3.

Figure 14:
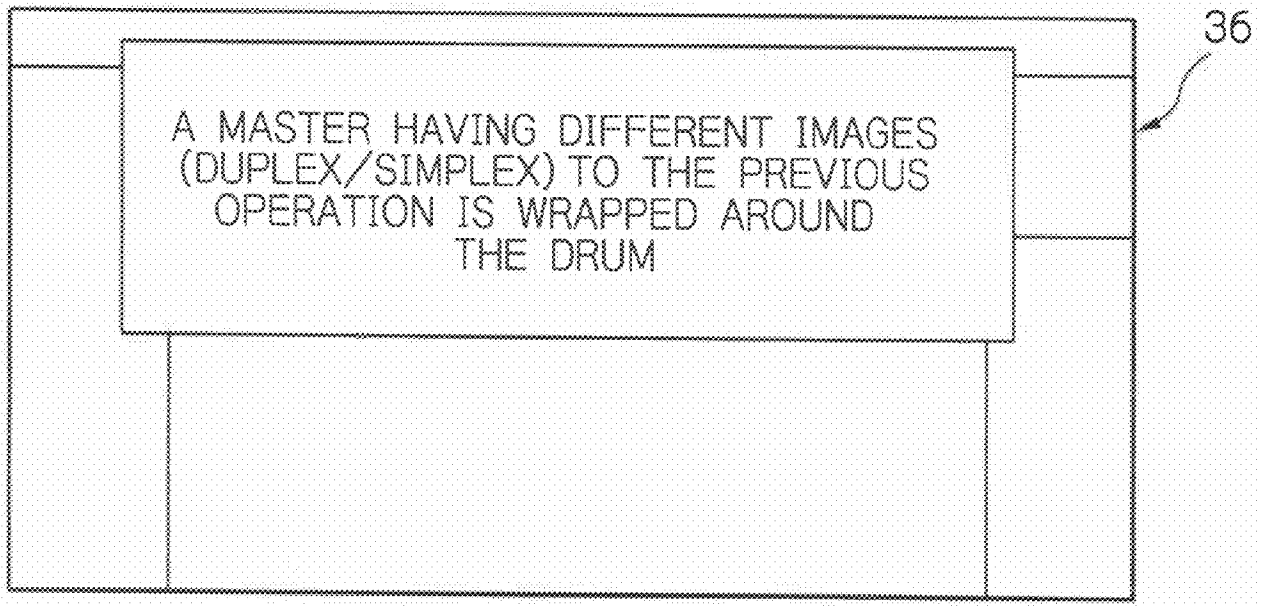
FIG. 14 is an enlarged view showing an example of warning content displayed by warning means in the third embodiment.

In the step E3, when the master is not wrapped around the printing drum 11, the control is terminated, and when the master is wrapped around the printing drum 11, the routine advances to the step E4, where the master identification information corresponding to the drum identification information is read from the storage unit 50 as a current value. The routine then advances to a step E5. In the step E5, the previously stored master identification information is read from the storage unit 60 as a previous value, whereupon the routine advances to a step E6. In the step E6, a determination is made as to whether or not the current value and the previous value are identical. When the current value and previous value are identical, the processing ends, and when the current value and previous value are different, the routine advances to a step E7, where warning content is displayed on the LCD display apparatus 36. The control is then terminated. As an example of the warning content, "a master having different images (duplex/simplex) to the previous operation is wrapped around the drum" may be displayed, as shown in FIG. 14.

Hence, a warning operation, in which warning content is displayed on the LCD display apparatus 36, is executed when the drum identification information, which is obtained anew during input of an operation command to the apparatus or an attachment/detachment command relating to the printing drum 11, and the master identification information stored in the storage unit 50 differ from the master identification information serving as the previous value stored in the storage unit 60, and therefore the apparatus operator can be warned that the printing drum 11 attached to the apparatus main body 43 or the master is different to that of the previous operation. In so doing, unnecessary engraving can be suppressed, leading to a decrease in master consumption.

When color printing using two or more colors is performed while exchanging the printing drum 11 and the warning display described above is not executed, erroneous printing in which the printed image is not positioned correctly or the like may occur. Such erroneous printing occurs when engraving is performed in advance for each color, and both duplex printing and simplex printing are performed while exchanging the printing drum such that the duplex master 14 engraved with duplex printing images is used first and the simplex master 15 engraved with a simplex printing image is used next. However, if the warning display described above is executed, the warning display is displayed on the LCD display apparatus 36 of the operating panel when the drum is exchanged, and therefore the apparatus operator can be warned.

Fourth Embodiment

In this embodiment, the master identification information and sheet size information corresponding to the master identification information are stored in the storage unit 50 in association with plate cylinder identification information during engraving, and if sheet size information corresponding to printing drum identification information that is detected (obtained) anew by the drum type detection sensor 55 when various apparatus operation commands are input into the control means 40 from the operating panel 30 or a printing drum attachment/detachment command is input from the drum attachment detection sensor 56 differs from the sheet size information stored in the storage unit 50, a warning operation is executed.

Figure 15:
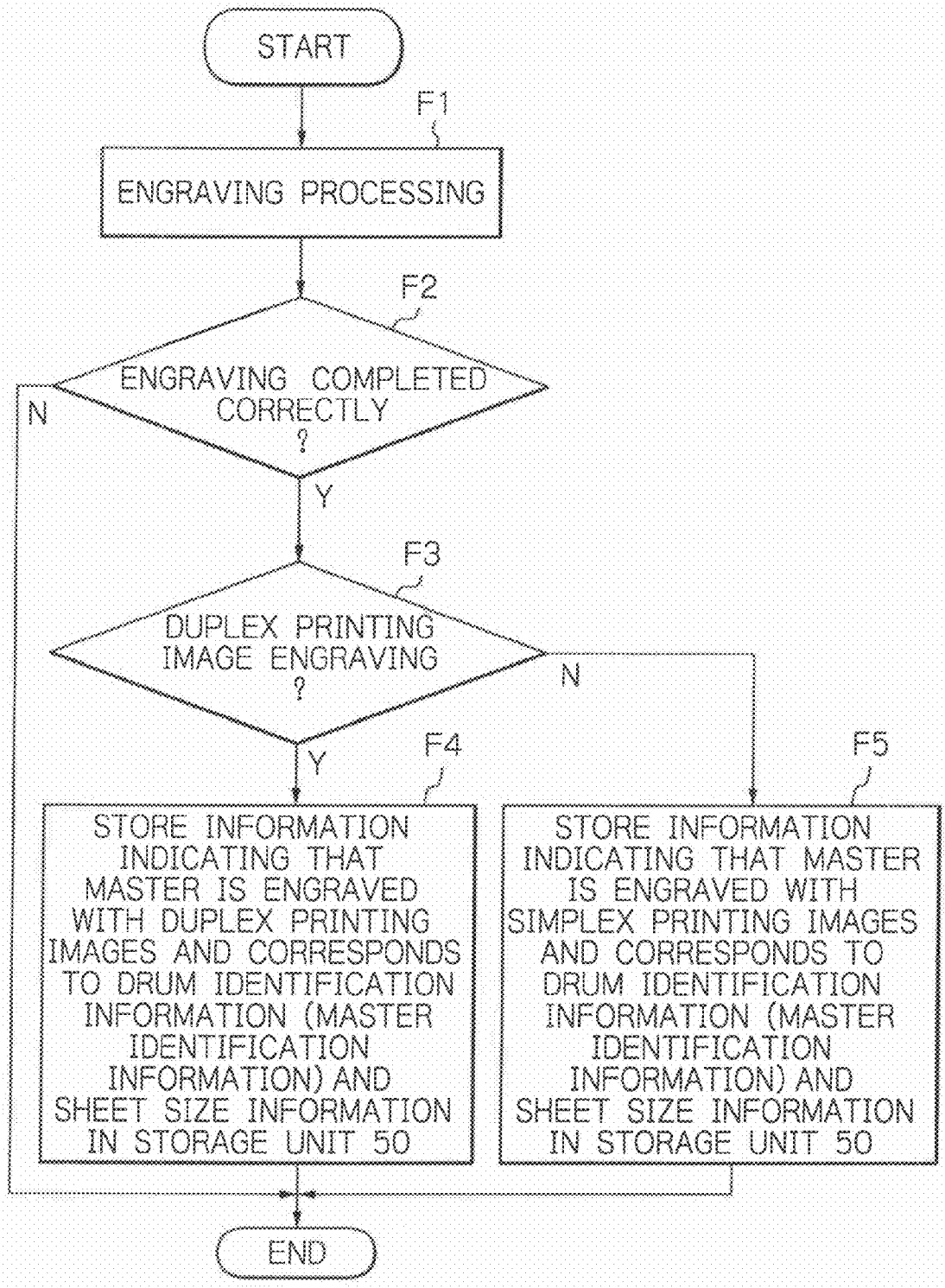
FIG. 15 is a flowchart showing an aspect of master identification information and sheet size information storage processing in the fourth embodiment.

The control means 40 execute processing for storing the master identification information and sheet size, as shown in FIG. 15. When engraving processing is executed in a step F1 of FIG. 15, a determination is made in a step F2 as to whether or not engraving has been completed correctly. When engraving has not been completed correctly, the storage processing is terminated, and when engraving has been completed correctly, the routine advances to a step F3. In the step F3, a determination is made as to whether or not duplex printing images have been engraved. When duplex printing images have been engraved, the routine advances to a step F4, and when duplex printing images have not been engraved, it is assumed that a simplex printing image has been engraved, and the routine advances to a step F5.

In the step F4, drum identification information from the drum identification detecting means 55, information indicating that the master is engraved with duplex printing images (i.e. that the master is the duplex master 14), and information indicating the sheet size that can be printed by this master, are stored in association in the storage unit 50, whereupon the control is terminated. In the step F5, drum identification information from the drum identification detecting means 55, information indicating that the master is engraved with a simplex printing image (i.e. that the master is the simplex master 15), and information indicating the sheet size that can be printed by this master, are stored in association in the storage unit 50, whereupon the control is terminated.

Figure 16:
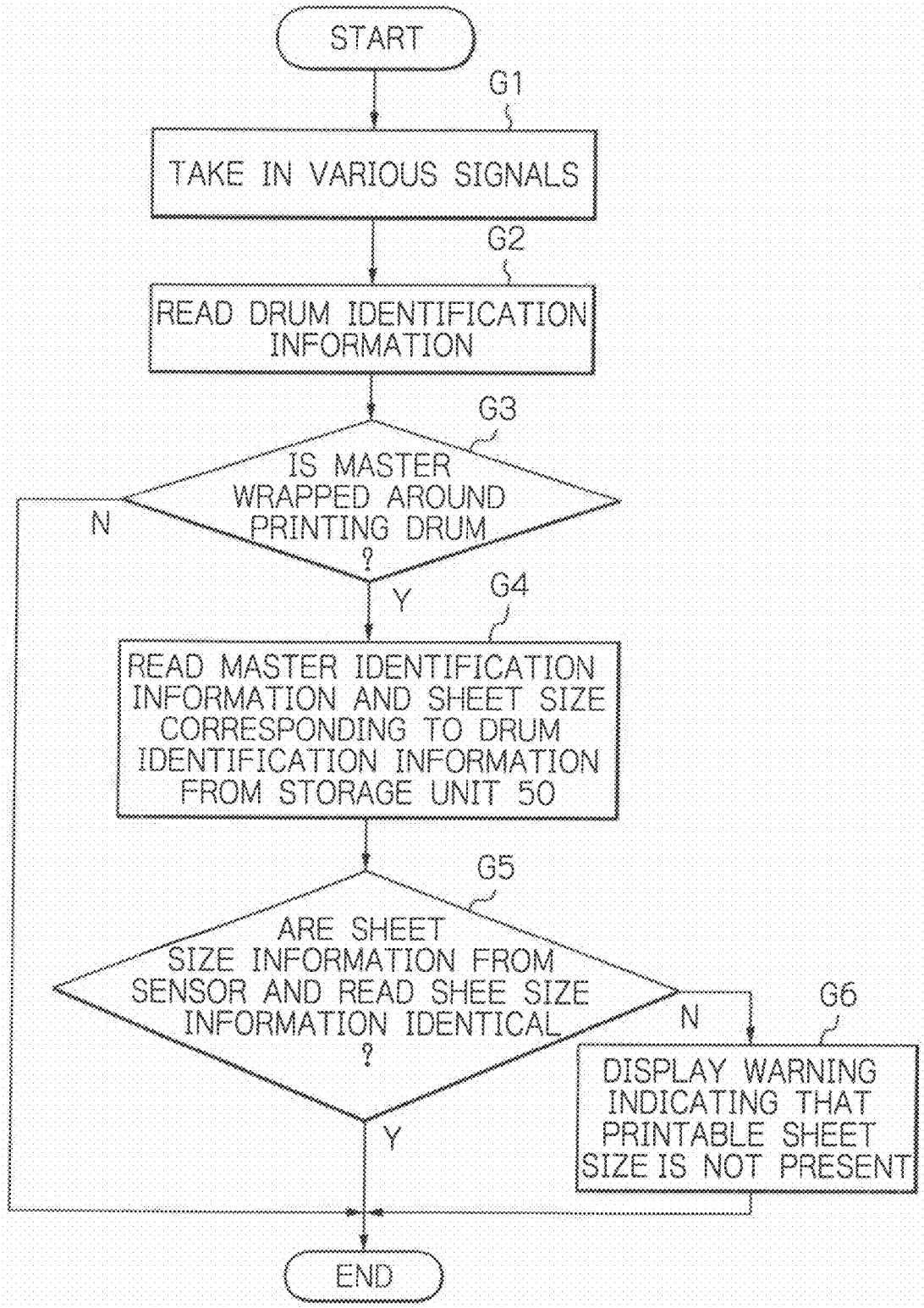
FIG. 16 is a flowchart showing an aspect of warning processing in the fourth embodiment.

The warning processing of this embodiment will now be described using the flowchart shown in FIG. 16. Steps G1 to G3 of FIG. 16 are identical in content to the steps B1 to B3.

In the step G3, when the master is not wrapped around the printing drum 11, the control is terminated, and when the master is wrapped around the printing drum 11, the routine advances to a step G4, where the master identification information and sheet size information corresponding to the drum identification information are read from the storage unit 50. The routine then advances to a step G5.

Figure 17:
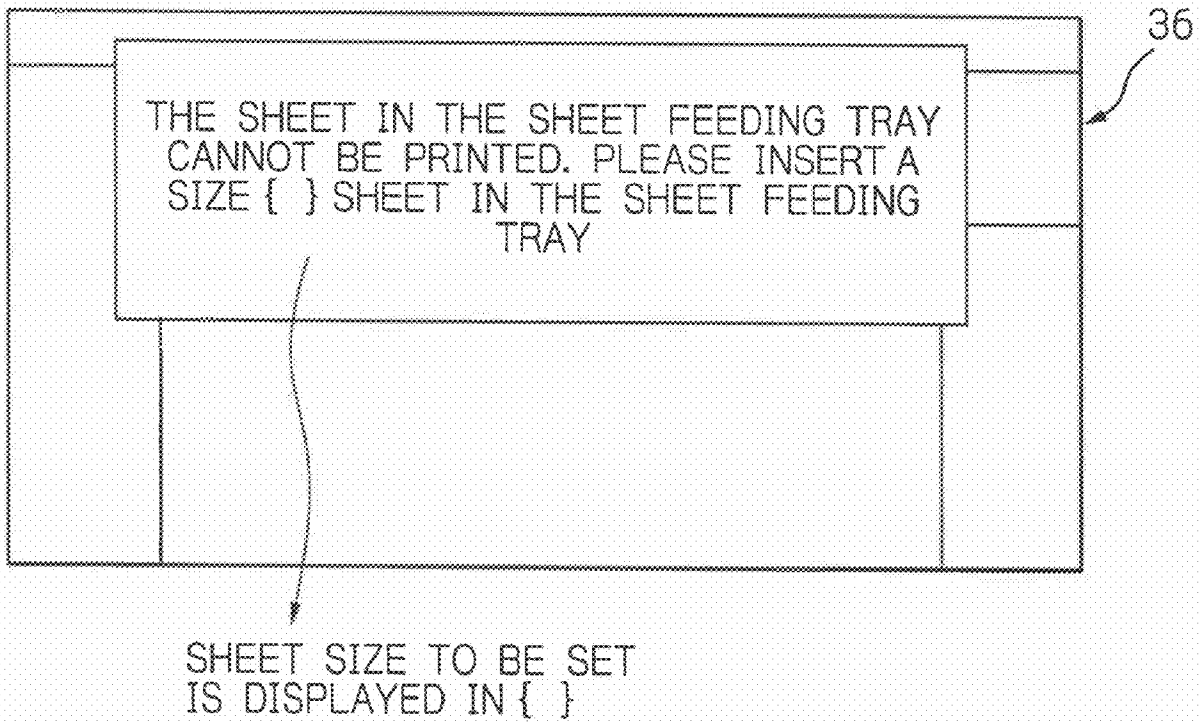
FIG. 17 is an enlarged view showing an example of warning content displayed by warning means in the fourth embodiment.

In the step G5, sheet size information from the sheet size detecting means 42 and the read sheet size information are compared, and a determination is made as to whether or not a sheet P that can actually be used for printing is set on the sheet feeding tray 41. Here, when the sheet size information from the sheet size detecting means 42 indicates a sheet size that can be used for printing, the control is terminated. When the sheet size information indicates a sheet size that cannot be used for printing, the routine advances to a step G6. In the step G6, warning content indicating that no sheets of a printable size are present on the sheet feeding tray 41 is displayed on the LCD display apparatus 36. The control is then terminated. As an example of the warning content, "the sheet in the sheet feeding tray cannot be printed. Please insert a size { } sheet in the sheet feeding tray" may be displayed, as shown in FIG. 17. The size of the sheet that should be set (for example, A4 vertical, B5 vertical) is displayed within { } in the drawing.

When two engraved images are formed on a single master and the auxiliary tray 8 is provided, as in the stencil printing apparatus shown in FIG. 1, the sheet sizes that can be printed by the master are limited by the images formed on the master. Hence, by executing a warning operation, in which warning content is displayed on the LCD display apparatus 36, when the drum identification information and sheet size information, which are obtained anew during input of an operation command to the apparatus or an attachment/detachment command relating to the printing drum 11, differ from the sheet size information stored in the storage unit 50 in association with the drum identification information, the apparatus operator can be warned thereof. As a result, situations in which the master breaks or ink adheres to the press roller 12 when simplex printing is performed mistakenly using the duplex master 14 or duplex printing is performed mistakenly using the simplex master 15 can be prevented, and master consumption due to re-engraving during duplex printing can be suppressed.

Fifth Embodiment

Figure 18:
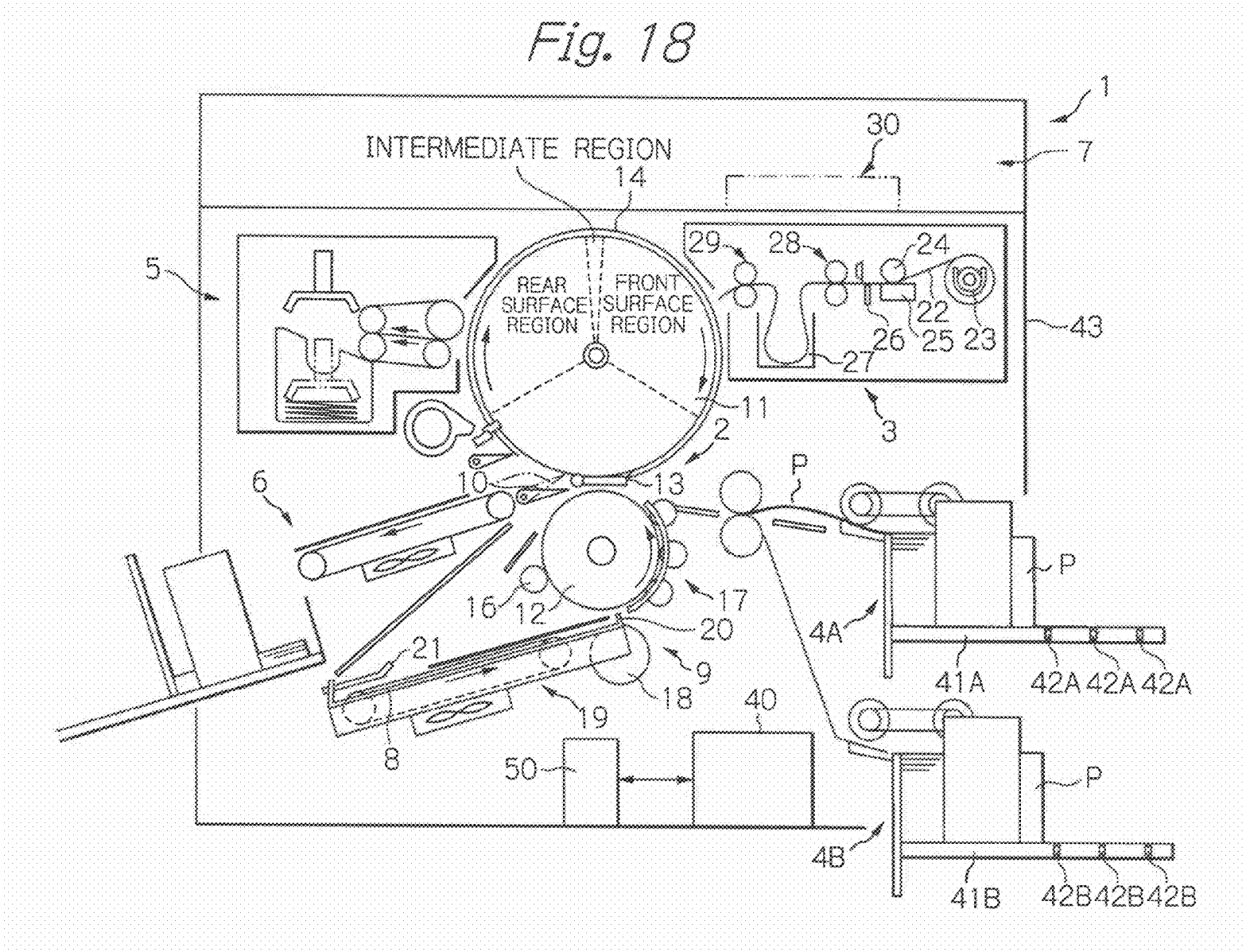
FIG. 18 is a front view showing the schematic constitution of a stencil printing apparatus to which the fifth embodiment of the present invention is applied.

In this embodiment, as shown in FIG. 18, the stencil printing apparatus comprises a plurality of sheet feeding units 4A and 4B for feeding the sheets P. The sheet feeding units 4A, 4B are constituted identically to the sheet feeding unit 4, and sheet feeding trays 41A, 41B thereof are provided respectively with sheet size detection sensors 41A, 42B for detecting the size of the sheets set on each tray. In this embodiment, the master identification information, indicating whether the master is engraved with duplex printing images or a simplex printing image during engraving, and sheet size information corresponding to the master identification information, are stored in the storage unit 50 in association with the drum identification information, and if sheet size information corresponding to printing drum identification information that is detected (obtained) anew by the drum type detection sensor 55 when various apparatus operation commands are input into the control means 40 from the operating panel 30 or a printing drum attachment/detachment command is input from the drum attachment detection sensor 56 differs from the sheet size information stored in the storage unit 50, a sheet feeding operation by the sheet feeding unit 4A or 4B in relation to which the different sheet size information was detected is prohibited.

Figure 19:
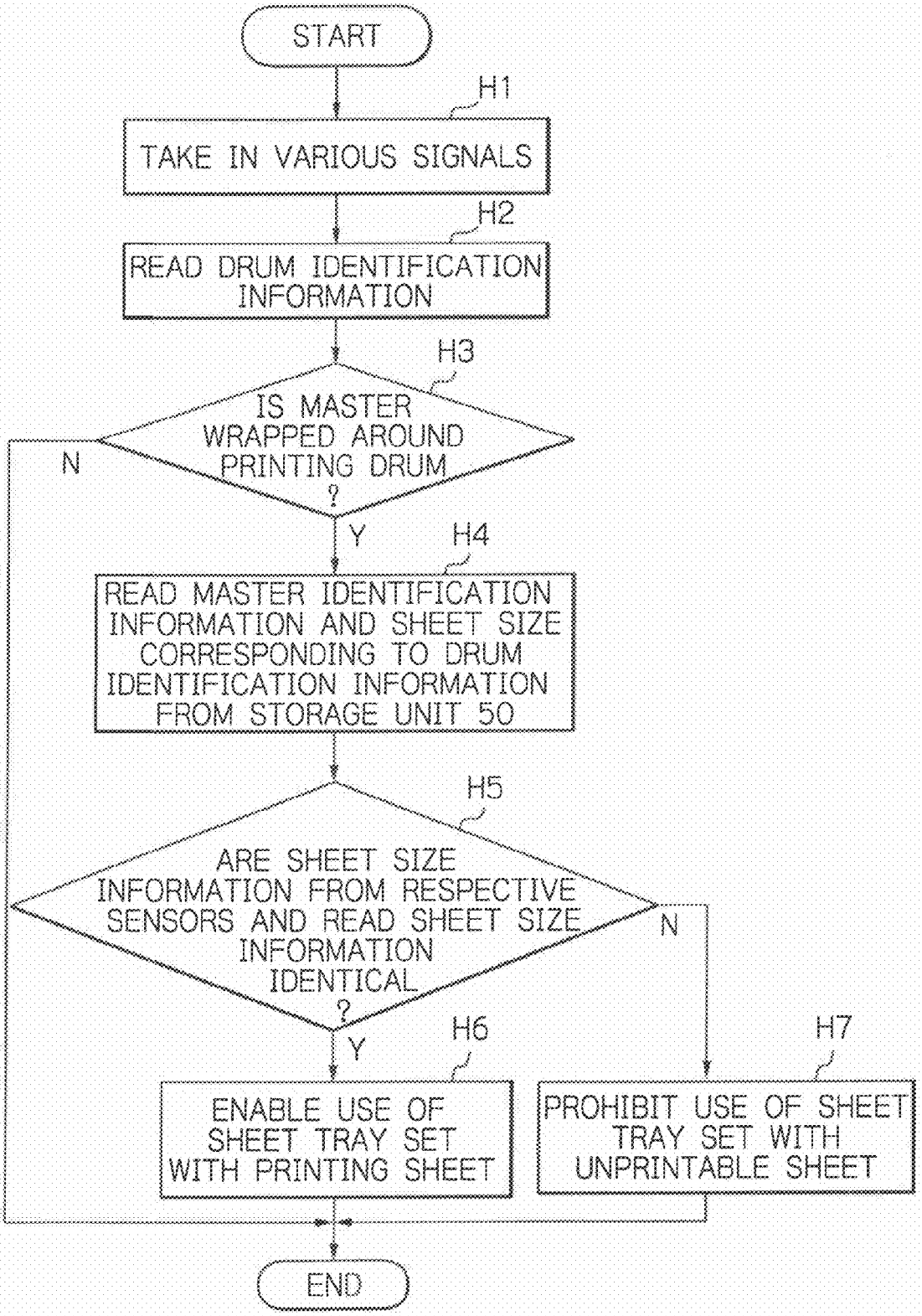
FIG. 19 is a flowchart showing an aspect of tray selection prohibition processing in the fifth embodiment.

The master identification information and sheet size are stored in the storage unit 50 using processing having the same steps as the processing shown in FIG. 15. Tray selection prohibition processing will now be described using the flowchart shown in FIG. 19. Steps H1 to H4 of FIG. 19 are identical in content to the steps G1 to G4. In the step H4, similarly to the step G4, the master identification information and sheet size information corresponding to the drum identification information are read from the storage unit 50, whereupon the routine advances to a step H5. In the step H5, sheet size information from the respective sheet size detecting means 42A, 42B and the sheet size information read from the storage unit 50 are compared, and the sheet feeding tray 41 set with a sheet P that can actually be used for printing is determined. When one of the sheet feeding trays is set with a sheet size that can be used for printing, measures are taken in a step H6 to ensure that this sheet feeding tray is used, whereupon the control is terminated. When one of the sheet feeding trays is set with a sheet size that can be used for printing, the routine advances to a step H7, where use of the sheet feeding tray set with the unprintable sheet is prohibited. The control is then terminated.

Figure 20A:
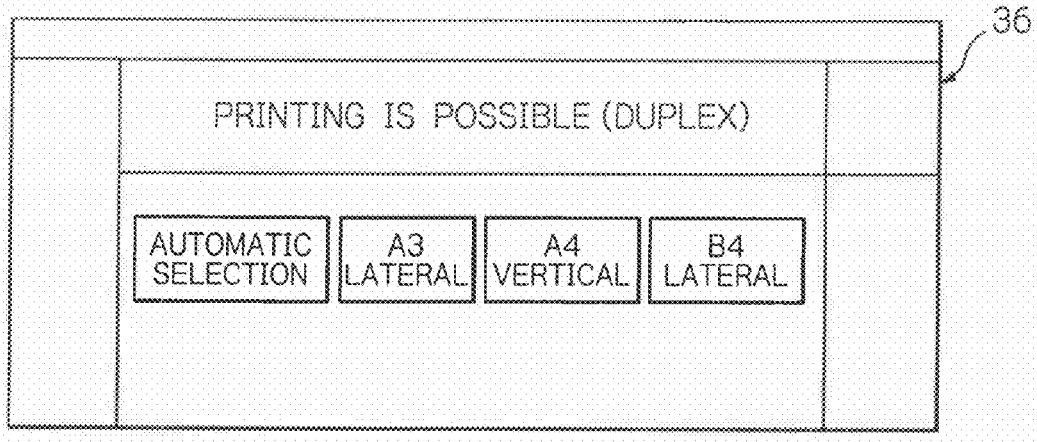
FIGS. 20A, 20B, and 20C are enlarged views showing examples of display content displayed by display means in the fifth embodiment.
Figure 20B:
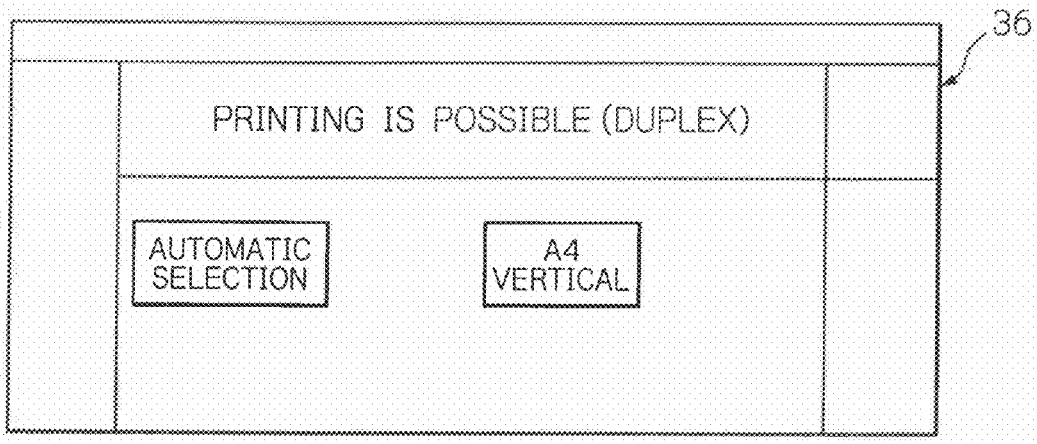
Figure 20C:
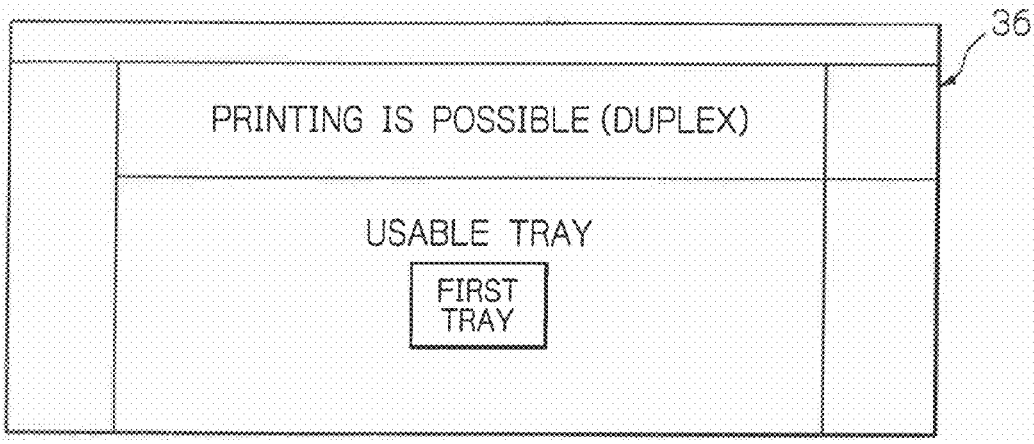

Here, making the sheet feeding tray set with a sheet size that can be used for printing usable involves displaying the sheet sizes set on the sheet feeding trays attached to the apparatus main body 43 on the LCD display apparatus 36 so that a usable sheet size can be selected therefrom, as shown in FIGS. 20A and 20B, or displaying the usable sheet feeding trays so that a usable tray can be selected, as shown in FIG. 20C, for example.

Prohibiting use of a sheet feeding tray set with a sheet size that cannot be used for printing may involve displaying the sheet size set on the sheet feeding tray 41A or the sheet feeding tray 41B attached to the apparatus main body 43 on the LCD display apparatus 36, and preventing selection of the sheet sizes that cannot be used by displaying these sheet sizes in the form of a matrix, as shown in FIG. 20A, not displaying the sheet sizes that cannot be used, as shown in FIG. 20B, or not displaying the sheet feeding tray set with an unusable sheet, as shown in FIG. 20C. In these cases, the LCD display apparatus 36 is preferably a so-called touch panel switch having a switch function, rather than simply a display apparatus. When use of a switch displayed on the LCD display apparatus 36 of the operating panel 30 is disabled or a switch is not displayed, the corresponding sheet feeding tray cannot be selected, and thus a sheet feeding operation by the sheet feeding unit comprising the corresponding sheet feeding tray can be prohibited.

When two engraved images are formed on a single master and the auxiliary tray 8 is provided, as in the stencil printing apparatus shown in FIG. 1, the sheet sizes that can be printed by the master are limited by the images formed on the master. Hence, when the sheet size information corresponding to the printing drum identification information that is detected (obtained) anew by the drum type detection sensor 55 differs from the sheet size information stored in the storage unit 50, a sheet feeding operation by the sheet feeding unit 4A or the sheet feeding unit 4B in which the different sheet size information is detected can be prohibited, and as a result, erroneous selection of an unprintable sheet size by the apparatus operator can be forestalled.

In each embodiment, the various control functions of the control means 40 were described individually. However, these embodiments may be combined appropriately and executed in a series of control operations having a plurality of control functions. For example, the first embodiment may be combined with the second and third embodiments, the first embodiment may be combined with the fourth embodiment, and the first embodiment may be combined with the fifth embodiment.

According to the present invention described above, the following effects are obtained.

(1) The duplex printing mode or the simplex printing mode is selected on the basis of at least plate cylinder identification information obtained anew when an operation command or a plate cylinder attachment/detachment command is input into the apparatus and master identification information stored in the storage unit in association with the plate cylinder identification information. Therefore, situations in which the master breaks or ink adheres to the pressing means when simplex printing is performed mistakenly using a master engraved with duplex printing images or duplex printing is performed mistakenly using a master engraved with a simplex printing image can be prevented, and master consumption due to re-engraving during duplex printing can be suppressed.

(2) The master identification information is displayed on the display means on the basis of at least plate cylinder identification information obtained anew when an operation command or a plate cylinder attachment/detachment command is input into the apparatus and master identification information stored in the storage unit in association with the plate cylinder identification information. Therefore, unnecessary engraving can be suppressed, leading to a decrease in master consumption, and the apparatus operator can prepare paper corresponding to the master more easily.

(3) A warning operation is executed when at least the plate cylinder identification information, which is obtained anew when an operation command or a plate cylinder attachment/detachment command is input into the apparatus, and the master identification information stored in the storage unit in association with the plate cylinder identification information differ from each other. Hence, the apparatus operator can be warned, and unnecessary engraving can be suppressed, leading to a decrease in master consumption.

(4) A warning operation is executed when at least the plate cylinder identification information obtained anew when an operation command or a plate cylinder attachment/detachment command is input into the apparatus and sheet size detection information from the sheet size detecting means differ from the master identification information and sheet size detection information stored in the storage unit in association with the plate cylinder identification information. Hence, the apparatus operator can be warned, situations in which the master breaks or ink adheres to the pressing means when simplex printing is performed mistakenly using a master engraved with duplex printing images or duplex printing is performed mistakenly using a master engraved with a simplex printing image can be prevented, and master consumption due to re-engraving during duplex printing can be suppressed.

(5) When at least the plate cylinder identification information obtained anew when an operation command or a plate cylinder attachment/detachment command is input into the apparatus and sheet size detection information from respective sheet size detecting means differ from the master identification information and sheet size detection information stored in the storage unit in association with the plate cylinder identification information, a sheet feeding operation by the sheet feeding unit in which the different sheet size information was detected is prohibited. Therefore, situations in which the master breaks or ink adheres to the pressing means when simplex printing is performed mistakenly using a master engraved with duplex printing images or duplex printing is performed mistakenly using a master engraved with a simplex printing image can be prevented, master consumption due to re-engraving during duplex printing can be suppressed, and erroneous selection by the apparatus operator of a sheet size that cannot be printed can be forestalled.

Various modifications will become possible for those skilled in the art after receiving the teachings of the present disclosure, without departing from the scope thereof.

What is claimed is:

1. A stencil printing apparatus having a plate cylinder that can be attached to and detached from an apparatus main body freely and pressing means provided so as to be free to contact and separate from said plate cylinder, with which duplex printing, in which a rear surface printing step is performed after a front surface printing step, and simplex printing can be performed alternately by wrapping a duplex master formed with a first engraved image and a second engraved image in a length direction thereof around said plate cylinder during duplex printing, and wrapping a simplex master formed with a third engraved image for simplex printing around said plate cylinder during simplex printing, said stencil printing apparatus comprising:

a storage unit for storing master identification information, indicating whether said master is engraved with duplex printing images or a simplex printing image during engraving, in association with plate cylinder identification information; and control means for selecting a duplex printing mode or a simplex printing mode on the basis of at least plate cylinder identification information obtained anew when an operation command or a plate cylinder attachment/detachment command is input into said apparatus, and said master identification information stored in said storage unit in association with said plate cylinder identification information.

2. A stencil printing apparatus having a plate cylinder that can be attached to and detached from an apparatus main body freely and pressing means provided so as to be free to contact and separate from said plate cylinder, with which duplex printing, in which a rear surface printing step is performed after a front surface printing step, and simplex printing can be performed alternately by wrapping a duplex master formed with a first engraved image and a second engraved image in a length direction thereof around said plate cylinder during duplex printing, and wrapping a simplex master formed with a third engraved image for simplex printing around said plate cylinder during simplex printing, said stencil printing apparatus comprising:

a storage unit for storing master identification information, indicating whether said master is engraved with duplex printing images or a simplex printing image during engraving, in association with plate cylinder identification information; and control means for displaying said master identification information on display means on the basis of at least plate cylinder identification information obtained anew when an operation command or a plate cylinder attachment/detachment command is input into said apparatus, and said master identification information stored in said storage unit in association with said plate cylinder identification information.

3. A stencil printing apparatus having a plate cylinder that can be attached to and detached from an apparatus main body freely and pressing means provided so as to be free to contact and separate from said plate cylinder, with which duplex printing, in which a rear surface printing step is performed after a front surface printing step, and simplex printing can be performed alternately by wrapping a duplex master formed with a first engraved image and a second engraved image in a length direction thereof around said plate cylinder during duplex printing, and wrapping a simplex master formed with a third engraved image for simplex printing around said plate cylinder during simplex printing, said stencil printing apparatus comprising:

a storage unit for storing master identification information, indicating whether said master is engraved with duplex printing images or a simplex printing image during engraving, in association with plate cylinder identification information; and control means for executing a warning operation when at least plate cylinder identification information obtained anew when an operation command or a plate cylinder attachment/detachment command is input into said apparatus differs from said master identification information stored in said storage unit in association with said plate cylinder identification information.

4. A stencil printing apparatus having a plate cylinder that can be attached to and detached from an apparatus main body freely and pressing means provided so as to be free to contact and separate from said plate cylinder, with which duplex printing, in which a rear surface printing step is performed after a front surface printing step, and simplex printing can be performed alternately by wrapping a duplex master formed with a first engraved image and a second engraved image in a length direction thereof around said plate cylinder during duplex printing, and wrapping a simplex master formed with a third engraved image for simplex printing around said plate cylinder during simplex printing, said stencil printing apparatus comprising:

a storage unit for storing master identification information, indicating whether said master is engraved with duplex printing images or a simplex printing image during engraving, and sheet size information corresponding to said master identification information, in association with plate cylinder identification information;

sheet size detecting means for detecting a sheet; and control means for executing a warning operation when at least plate cylinder identification information obtained anew when an operation command or a plate cylinder attachment/detachment command is input into said apparatus and sheet size detection information from said sheet size detecting means differ from said master identification information and said sheet size detection information stored in said storage unit in association with said plate cylinder identification information.

* * * * *